US010020586B1

(12) United States Patent
Georgakopoulos et al.

(10) Patent No.: US 10,020,586 B1
(45) Date of Patent: Jul. 10, 2018

(54) SEGMENTED HELICAL ANTENNA WITH RECONFIGURABLE POLARIZATION

(71) Applicants: Stavros Georgakopoulos, Boca Raton, FL (US); Shun Yao, Miami, FL (US)

(72) Inventors: Stavros Georgakopoulos, Boca Raton, FL (US); Shun Yao, Miami, FL (US)

(73) Assignee: The Florida International University Board of Trustees, Miami, FL (US)

( * ) Notice: Subject to any disclaimer, the term of this patent is extended or adjusted under 35 U.S.C. 154(b) by 0 days.

(21) Appl. No.: 15/643,981

(22) Filed: Jul. 7, 2017

(51) Int. Cl.
*H01Q 1/36* (2006.01)
*H01Q 11/08* (2006.01)
*H01Q 9/14* (2006.01)
*H01Q 1/38* (2006.01)

(52) U.S. Cl.
CPC ..... *H01Q 11/086* (2013.01); *H01Q 1/362* (2013.01); *H01Q 1/38* (2013.01); *H01Q 9/145* (2013.01)

(58) Field of Classification Search
CPC ..... H01Q 11/08; H01Q 1/362; H01Q 1/36; H01Q 21/28; H01Q 5/0006
USPC ..... 343/895, 725, 729
See application file for complete search history.

(56) References Cited

U.S. PATENT DOCUMENTS 5,910,790 A * 6/1999 Ohmuro ..... H01Q 11/08 343/895
6,222,505 B1 * 4/2001 Endo ..... H01Q 1/242 343/702
2002/0018026 A1 * 2/2002 Noro ..... H01Q 1/362 343/895
2014/0340275 A1 * 11/2014 Georgakopoulos ..... H01Q 1/36 343/834

OTHER PUBLICATIONS

Knudsen, "Radiation field of a square, helical beam antenna," Journal of Applied Physics, Apr. 1952, pp. 183-491, vol. 23, No. 4.
Wang et al., "A miniature quadrifilar helix antenna for global positioning satellite reception," IEEE Transactions on Antennas and Propagation, Dec. 2009, pp. 3746-3751, vol. 57, No. 12.
Barts et al., "A reduced size helical antenna," IEEE Antennas and Propagation Society International Symposium, Jul. 1997, pp. 1588-1591.
Nauroze et al., "A novel printed stub-loaded square helical antenna," IEEE International Symposium on Antennas and Propagation and Usnciursi National Radio Science Meeting, Jul. 2015, pp. 774-775.
Chew et al., "Meander line technique for size reduction of quadrifilar helix antenna," IEEE Antennas and Wireless Propagation Letters, 2002, pp. 109-111, vol 1.
(Continued)

*Primary Examiner* — Dameon E Levi
*Assistant Examiner* — Collin Dawkins
(74) *Attorney, Agent, or Firm* — Saliwanchik, Lloyd & Eisenschenk

(57) ABSTRACT

A segmented helical antenna can include: a plurality of unit arms, each unit arm having a center hole, a first end hole, and a second end hole; a central axis passing through the center hole of the plurality of unit arms; a first wire passing through the first end hole of each of the plurality of unit arms; and a second wire passing through the second end hole of each of the plurality of unit arms. Each unit arm can be configured to be rotatable such that the first wire and the second wire rotate clockwise or counterclockwise.

19 Claims, 22 Drawing Sheets

(56) References Cited

OTHER PUBLICATIONS

Costantine et al., "UHF deployable helical antennas for cubesats," IEEE Transactions on Antennas and Propagation, Sep. 2016, pp. 3752-3759, vol. 64, No. 9.
Liu et al., "Frequency reconfigurable origami quadrifilar helical antenna with reconfigurable reflector," IEEE International Symposium on Antennas and Propagation and USNC/URSI National Radio Science Meeting, Jul. 2015, pp. 2263-2264.
Bao et al., "Monofilar spiral slot antenna for dual-frequency dual-sense circular polarization," IEEE Transactions on Antennas and Propagation, Aug. 2011, pp. 1-5, vol. 59, No. 8.
Demaine et al., "History of curved origami sculpture," May 2015, pp. 1-7, http://erikdemaine.org/curved/history/.
Demaine et al., "Polyhedral sculptures with hyperbolic paraboloids," Proceedings of the Second Annual Conference of Bridges: Mathematical Connections in Art, Music, and Science, Jul. 1999, pp. 91-100.
Yao et al., "Polarization switchable origami helical antenna," IEEE International Symposium on Antennas and Propagation, Jun. 2016, pp. 1667-1668.
Weeratumanoon, "Helical antennas with truncated spherical geometry," Master of Science in Electrical Engineering Thesis, Jan. 27, 2000, pp. 1-94, Virginia Polytechnic Institute, Blacksburg,Virginia.
Casey et al., "Square helical antenna with a dielectric core," IEEE Transactions on Electromagnetic Compatibility, Nov. 1988, pp. 429-436, vol. 30, No. 4.
Britton et al., "Low-cost square cross section helical antennas," Symposium on Antenna Technology and Applied Electromagnetics, Jul. 2000, pp. 425-428.
Young et al., "Reducing the size of helical antennas by means of dielectric loading," IEEE Pulsed Power Conference, Jun. 2011, pp. 1-5.
Takacs et al., "Miniaturization of quadrifilar helix antenna for VHF band applications," 2009 Loughborough Antennas and Propagation Conference, Nov. 2009, pp. 597-600.
Hebib et al., "Compact printed quadrifilar helical antenna with iso-flux-shaped pattern and high cross-polarization discrimination," IEEE Antennas and Wireless Propagation Letters, Jun. 2011, pp. 635-638, vol. 10.
Rabemanantsoa et al., "Size reduced multi-band printed quadrifilar helical antenna," IEEE Transactions on Antennas and Propagation, Sep. 2011, pp. 3138-3143, vol. 59, No. 9.
Liu et al., "An origami reconfigurable axial-mode bifilar helical antenna," IEEE Transactions on Antennas and Propagation, Dec. 2015, pp. 5897-5903, vol. 63, No. 12.
Hsu et al., "Dual-frequency dual-sense circular polarization on asymmetric crossed-dipole antenna," IEEE Antennas and Propagation Society International Symposium, Jul. 2012, pp. 1-2.
Boti et al., "Circularly polarised antenna with switchable polarisation sense," Electronics Letters, Aug. 2000, pp. 1518-1519, vol. 36, No. 18.
Ushijima et al., "Circular polarization switchable microstrip antenna with SPDT switching circuit," Antennas and Propagation Society International Symposium, Jul. 2010, pp. 1-4.
Li et al., "16-element single-layer rectangular radial line helical array antenna for high-power applications," IEEE Antennas and Wireless Propagation Letters, Jul. 2010, pp. 708-711, vol. 9.

* cited by examiner (a)

(b)

(c)

(d)

(e)

(f)

(g)

(h)

GEOMETRY PARAMETERS OF THE SEGMENTED HELICAL ANTENNAS

| Geometric Parameters | Hexagon Segmented Helical Antenna | Square Segmented Helical Antenna |
|---|---|---|
| Top View | | |
| Number of Turns, *N* | 2 | 2 |
| Antenna Height | 160 mm | 160 mm |
| Number of Units, *n* | 12 | 8 |
| Angle Between the Adjacent Arms | 60° | 90° |
| Unit Height, *h* | 13.3 mm | 20 mm |
| Segment Length | 51.75 mm | 73.5 mm |
| Total Length of Each Copper Wire | 621 mm | 588 mm |

Figure 23

MEASURED FAR-FIELD CHARACTERISTICS OF ORIGAMI SHA

| Far-field Characteristics | 0.77 GHz | 0.98 GHz | 1.2 GHz | 1.34 GHz |
|---|---|---|---|---|
| Axial Ratio | 14.3 dB | 0.94 dB | 2.75 dB | 4.46 dB |
| Co-polarization Realized Gain | 2.68 dBi | 6.82 dBi | 5.35 dBi | 5.77 dBi |
| Cross-polarization Realized Gain | -0.72 dBi | -9.28 dBi | -23.29 dBi | -6.22 dBi |
| E-plane HPBW | 63° | 62° | 95° | 79° |
| H-plane HPBW | 82° | 69° | 91° | 84° |

Figure 24

COMPARISON BETWEEN THE SHAS AND THE CONVENTIONAL HA

| Antenna Characteristics | Skeleton Hexagon SHA | Skeleton Square SHA | Origami SHA | Conventional HA |
|---|---|---|---|---|
| **Pitch Angle** | 14.4° | 15.2° | 13.4° | 14.2° |
| **Operating Frequency** | 1.08 GHz | 1.16 GHz | 0.98 GHz | 1.03 GHz |
| **Axial Ratio** | 0.74 dB | 1.12 dB | 0.94 dB | 0.72 dB |
| **Co-polarization Realized Gain** | 8.1 dBi | 7.73 dBi | 6.82 dBi | 8.22 dBi |
| **Cross-polarization Realized Gain** | -11.32 dBi | -13.96 dBi | -9.28 dBi | -9.76 dBi |
| **E-plane HPBW** | 55° | 58° | 62° | 57° |
| **H-plane HPBW** | 56° | 57° | 69° | 56° |

Figure 25

SIMULATED GAIN VERSUS NUMBER OF TURNS OF THE BIFILAR SKELETON SHA

| Number of Turns | 2 | 4 | 6 | 8 | 10 |
|---|---|---|---|---|---|
| **Hexagon SHA Gain (dBi)** | 9.94 | 11.5 | 13.23 | 14 | 14.38 |
| **Square SHA Gain (dBi)** | 9.85 | 11.27 | 12.85 | 13.64 | 14.04 |

Figure 26

SEGMENTED HELICAL ANTENNA WITH RECONFIGURABLE POLARIZATION

STATEMENT OF GOVERNMENT SUPPORT

This invention was made with government support under Grant EFRI1332348 awarded by National Science Foundation. The government has certain rights in the invention.

BACKGROUND

Axial mode conventional helical antennas (HAs) have been widely used in satellite communications and global positioning systems due to their high gain and circular polarization (CP). The properties of conventional helical antennas have been extensively studied. Segmented helical antennas (SHAs), such as square cross section helical antennas, have been investigated [1]-[3]. The SHAs can provide approximately equivalent performance compared to the conventional helical antenna. The linear segments, which make up an SHA can be easily supported on a dielectric structure. This kind of structure can be designed and manufactured at a very low cost. In addition, the traditional helical antenna only has one sense: either right-hand circular polarization (RHCP) or left-hand circular polarization (LHCP), which is decided by its rolling direction. Thus, CP sense switchable antennas have been developed [18], [17]. However, these antennas need extra switching circuits and power supply. Also, the gain (6 dBi) of existing CP switchable antennas is lower than that of a traditional helical antenna [21].

BRIEF SUMMARY

Embodiments of the subject invention provide novel and advantageous segmented helical antennas that have two stable states including a right-hand circular polarization (RHCP) state and a left-hand circular polarization (LHCP) state that can be switched easily by mechanical rotation.

In an embodiment, a segmented helical antenna can comprise a plurality of origami units having a plurality of metal traces, a support post passing through the plurality of origami units, and an arm disposed on a top of the support post and glued on a top edge of the plurality of origami units, wherein the plurality of origami units is configured to be rotatable with the arm such that the plurality of metal traces extends in a clockwise direction or in a counterclockwise direction.

In another embodiment, a segmented helical antenna can comprise a plurality of unit arms, each of plurality of unit arms having a center hole, a first end hole, and a second end hole, a central axis passing through the center hole of the plurality of unit arms, a first wire passing through the first end hole of each of the plurality of unit arms, and a second wire passing through the second end hole of each of the plurality of unit arms, wherein each of the plurality of unit arms is configured to be rotatable such that the first wire and the second wire rotate clockwise or counterclockwise.

In yet another embodiment, a segmented helical antenna can comprise a plurality of unit arms, each of plurality of unit arms having a center hole, a first end hole, and a second end hole, a plurality of posts disposed between the plurality of unit arms, a first wire passing through the first end hole of each of the plurality of unit arms, and a second wire passing through the second end hole of each of the plurality of unit arms, wherein each of the plurality of posts includes a first portion supporting the plurality of unit arms and a second portion passing through the center hole of the plurality of unit arms, and wherein each of the plurality of unit arms is rotatable.

BRIEF DESCRIPTION OF DRAWINGS

FIG. 2(*b*) shows the origami segmented helical antenna according to an embodiment of the subject invention at a right-handed state.

FIG. 3(*b*) shows a collapsed support post of the origami segmented helical antenna according to an embodiment of the subject invention.

FIG. 3(*c*) shows the folded origami segmented helical antenna according to an embodiment of the subject invention.

FIG. 4(*b*) shows the hyperbolic paraboloid origami.

FIG. 5(*b*) shows an origami rectangle unit pattern for the hyperbolic paraboloid with antenna traces.

FIG. 5(*c*) shows a top view of the rectangle hyperbolic paraboloid origami unit.

FIG. 5(*d*) shows a side view of the rectangle hyperbolic paraboloid origami unit.

FIG. 8(*b*) shows a side view of the conventional helical antenna.

FIG. 8(*c*) shows a top view of the origami segmented helical antenna according to an embodiment of the subject invention.

FIG. 8(*d*) shows a top view of the conventional helical antenna.

FIG. 9(*b*) shows the hexagon skeleton segmented helical antenna according to an embodiment of the subject invention at a right-handed state.

FIG. 9(*c*) shows a square skeleton segmented helical antenna according to an embodiment of the subject invention at a left-handed state.

FIG. 9(*d*) shows the square skeleton segmented helical antenna according to an embodiment of the subject invention at a right-handed state.

FIG. 11(*b*) shows the compressed deployable skeleton segmented helical antenna according to an embodiment of the subject invention.

FIG. 12(*b*) shows the segmented helical antenna according to an embodiment of the subject invention at left-handed state.

FIG. 13(*b*) shows a transparent view of the unit of the segmented helical antenna according to an embodiment of the subject invention.

FIG. 17(*b*) shows measured the right-hand circular polarization (RHCP) and left-hand circular polarization (LHCP) elevation patterns of the origami segmented helical antenna according to an embodiment of the subject invention at φ=90°, at the left-handed state, and at 0.98 GHz.

FIG. 17(*c*) shows measured the right-hand circular polarization (RHCP) and left-hand circular polarization (LHCP) elevation patterns of the origami segmented helical antenna according to an embodiment of the subject invention at φ=0°, at the right-handed state, and at 0.98 GHz.

FIG. 17(*d*) shows measured the right-hand circular polarization (RHCP) and left-hand circular polarization (LHCP) elevation patterns of the origami segmented helical antenna according to an embodiment of the subject invention at φ=90°, at the right-handed state, and at 0.98 GHz.

FIG. 18(*b*) shows a manufactured square skeleton segmented helical antenna according to an embodiment of the subject invention.

FIG. 19(*b*) shows measured elevation patterns for RHCP and LHCP components of the electric field of the hexagon skeleton segmented helical antenna for φ=90° at the right-handed state.

FIG. 19(*c*) shows measured elevation patterns for RHCP and LHCP components of the electric field of the hexagon skeleton segmented helical antenna for φ=0° at the left-handed state.

FIG. 19(*d*) shows measured elevation patterns for RHCP and LHCP components of the electric field of the hexagon skeleton segmented helical antenna for φ=90° at the left-handed state.

FIG. 19(*e*) shows measured elevation patterns for RHCP and LHCP components of the electric field of the square skeleton segmented helical antenna for φ=0° at the right-handed state.

FIG. 19(*f*) shows measured elevation patterns for RHCP and LHCP components of the electric field of the square skeleton segmented helical antenna for φ=90° at the right-handed state.

FIG. 19(*g*) shows measured elevation patterns for RHCP and LHCP components of the electric field of the square skeleton segmented helical antenna for φ=0° at the left-handed state.

FIG. 19(*h*) shows measured elevation patterns for RHCP and LHCP components of the electric field of the square skeleton segmented helical antenna for φ=90° at the right-handed state.

FIG. 20(*b*) shows a top view of the manufactured segmented helical antenna according to an embodiment of the subject invention.

FIG. 22(*b*) shows the RHCP and LHCP realized gain pattern of the segmented helical antenna according to an embodiment of the subject invention at the left-handed state.

FIG. 23 shows geometric parameters of the hexagon and squire skeleton SHAs that are shown in FIGS. 9(*a*)-9(*d*).

FIG. 24 shows measured far-field performance metrics of an origami SHA of an embodiment of the subject invention.

FIG. 25 shows a comparison between SHAs of embodiments of the subject invention and a conventional HA.

FIG. 26 shows the variation of the simulated gain versus the number of turns for bifilar skeleton SHAs of embodiments of the subject invention.

DETAILED DESCRIPTION

Embodiments of the subject invention provide novel and advantageous segmented helical antennas including a right-hand circular polarization (RHCP) state and a left-hand circular polarization (LHCP) state that can be switched easily by mechanical rotation.

A segmented helical antenna (SHA) of an embodiment of the subject invention can switch its sense of polarization by rotating around its center axis. The embodiment of the subject invention includes two implementation methods (one based on origami folding and one based on skeleton scaffolding). Example bifilar SHA designs are presented for the UHF frequency band. The SHA of the embodiment of the subject invention has two stable states of operation, one with right-hand circular polarization (RHCP) and one with left-hand circular polarization (LHCP). The sense of polarization of this antenna can be controlled and switched using mechanical rotation. Therefore, this antenna of the embodiment of the subject invention exhibits reconfigurable polarization performance.

The physical size of helical antennas becomes considerably large at lower frequencies and requires a strong mechanical support. Several methods to reduce the total antenna volume have been developed and studied. A dielectric rod inside the helix was introduced. The volume of such antenna is tremendously decreased by 95%, but the gain is also decreased (below 4 dBi). Placing radial stubs along the circumference of the helix without affecting the radiation characteristics of the antenna was studied. The stubs increase the electrical length of antennas, and 40%-70% antenna volume reduction is achieved. However, the stubs change the input impedance of the antenna and a matching network is necessary in such designs. Meandering radiating elements of the helical antenna were used. The volume of these antennas was approximately 50% smaller compared to traditional helical antennas, but the axial ratio and the beamwidth of these antennas were compromised.

Deployable helical antennas for CubeSats have been investigated recently. Bifilar and quadrifilar HAs, which have better gain and lower beamwidth than a monofilar HA, are used in these designs. These antennas are composed of conductors that are supported by novel structures. This allows efficient folding, packaging, and deployment in space. A UHF quadrifilar helical antenna, supported by helical arms of S2 glass fiber reinforced epoxy, was designed. The structure has the potential to deploy itself by releasing its stored strain energy. Origami based helical antennas have been developed. The origami helical antennas have comparable performance to conventional helical antennas. Also, origami helical antennas can operate at different frequency bands by adjusting the height of the origami cylinders that support them.

Figure 1:
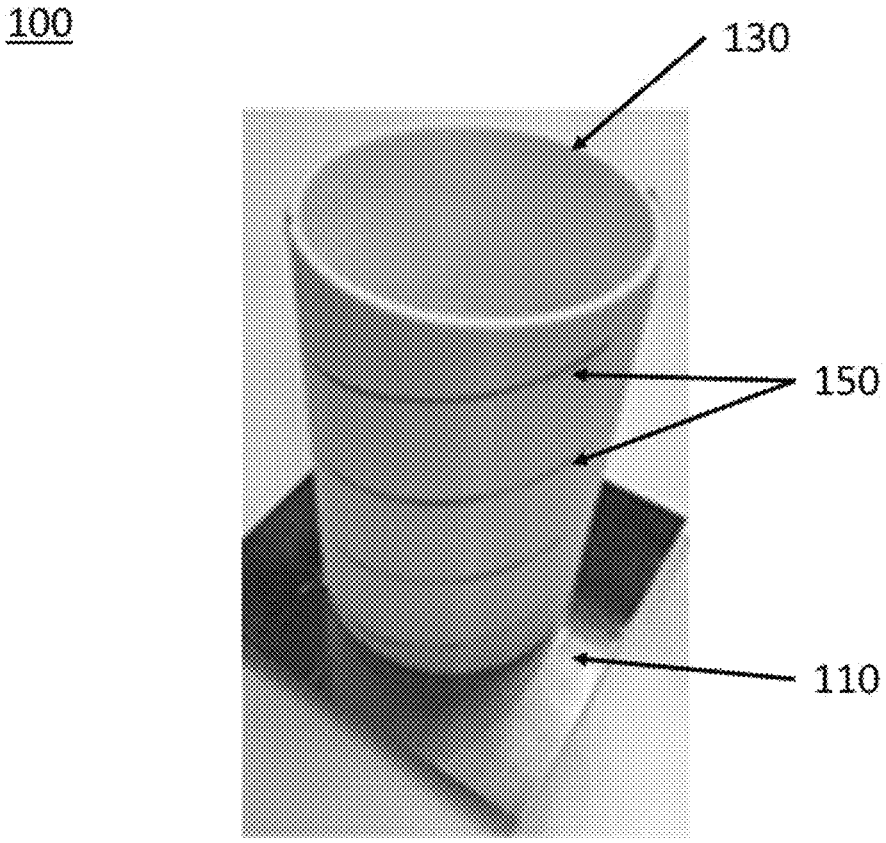
Figure 1 (Prior Art)
FIG. 1 shows a conventional helical antenna.

FIG. 1 shows a conventional helical antenna. Referring to FIG. 1, the helical antenna 100 comprises a base 110, a post 130 disposed and standing on the base 110, and a wire 150 disposed on the post 130 and winding the post 130. In case that the helical antenna 100 is the bifilar helical antenna, the wire 150 includes two wires. Once the wire 150 is disposed on the post 130, the wire 150 cannot change its extending and winding direction.

Similar to the helical antenna 100 of FIG. 1, most circular polarized (CP) helical antennas only have one sense of polarization: right-hand circular polarization (RHCP) or left-hand polarization (LHCP). The sense of CP field of the helical antenna is determined by the direction of twist of the helix arms. In some applications, dual-band reception of both RHCP and LHCP signals are required. Dual sense CP antennas have been investigated, such as cross dipole antennas and slot antennas. In such antennas, the directions of the peak gain at the two states are opposite, and the gain is low (below 4 dBi). Though CP sense switchable antennas have also been developed, these antennas need extra switching circuits and power supplies.

Figures 2A, 2B:
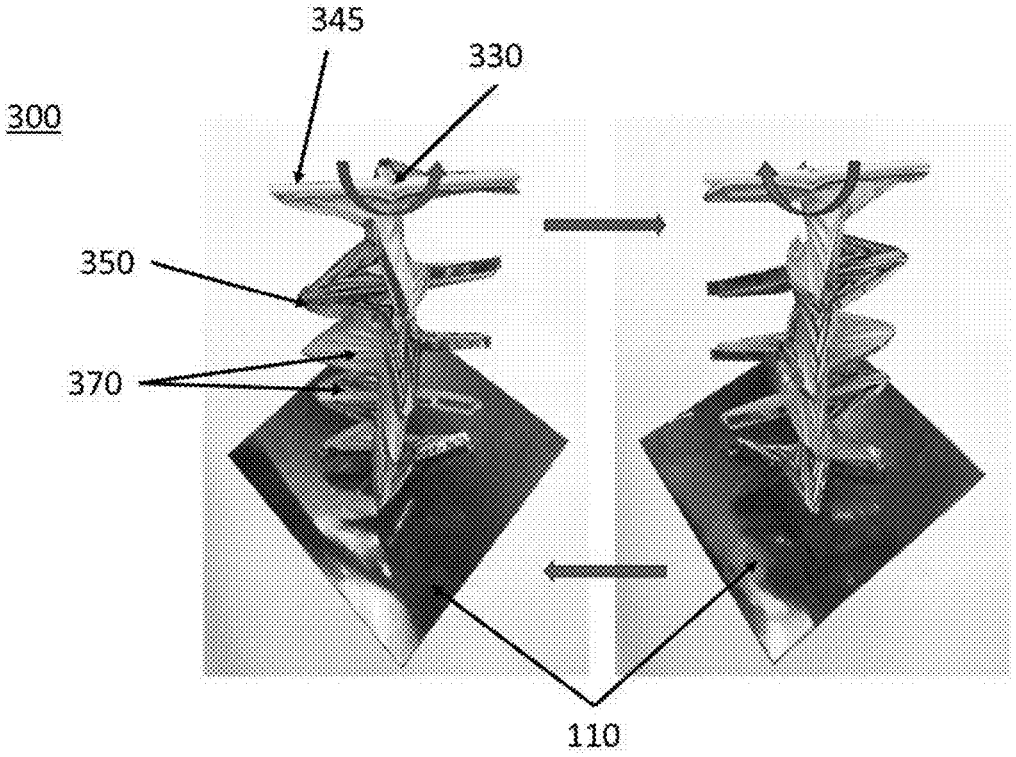
FIG. 2(*a*) shows an origami segmented helical antenna according to an embodiment of the subject invention at a left-handed state.
Figure 3A:
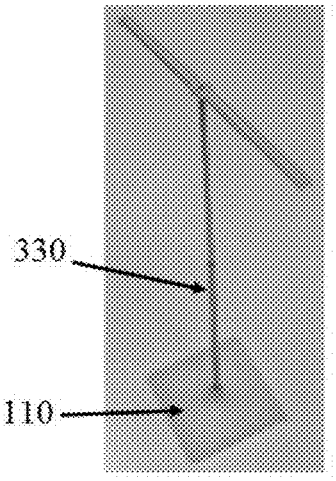
FIG. 3(*a*) shows an expanded support post of the origami segmented helical antenna according to an embodiment of the subject invention.
Figure 3B:
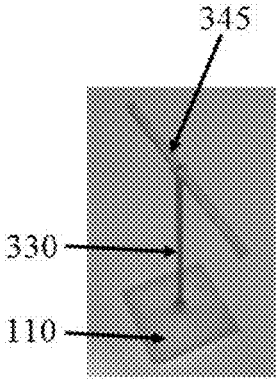
Figure 3C:
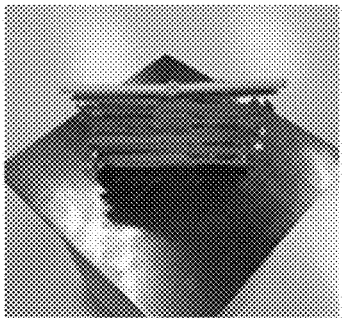

FIGS. 2(*a*) and 2(*b*) show an origami segmented helical antenna according to an embodiment of the subject invention at a left-handed state and at a right-handed state, respectively. FIG. 3(*a*) shows an expanded support post of the origami segmented helical antenna, FIG. 3(*b*) shows a collapsed support post of the origami segmented helical antenna, and FIG. 3(*c*) shows the folded origami segmented helical antenna. Referring to FIGS. 2(*a*)-3(*c*), the origami segmented helical antenna (SHA) 300 comprises a base 110, a plurality of origami units 370 disposed on the base 110, a support post 330 standing on the base 110 and passing through the plurality of origami units 370, and a top arm 345 disposed on a top of the support post 330 and glued on a top edge of the plurality of origami units 370. The origami SHA 300 further comprises a metal trace 350.

The top arm 345 is rotatable with respect to the support 330, thus the plurality of origami units 370 attached to the top arm 345 is rotated by rotating the top arm 345. When the plurality of origami unit 370 is rotated, the metal trace 350 formed on the edge of the plurality of origami units 370 changes its extending direction from a clockwise direction to a counterclockwise direction or vice versa when viewed from a top. Thus, the origami SHA 300 can change the sense of polarization between the RHCP and the LHCP by using easy mechanical rotation.

The metal trace 350 is constructed using 50 μm-thick copper tape on 100 μm-thick sketching-paper substrate of the origami unit 370 without any coating. The copper tape is glued on the paper and creased with the paper, so that it will stay attached to the paper substrate when the antenna is rotating. The width of the copper trace is 3 mm. The two copper traces of the metal trace 350 are fed using SMA connectors. The feeding network adopted for this origami segmented helical antenna uses a broadband 180° hybrid coupler. A support post 330 is placed in the center axis of the origami structure including the plurality of origami units 370, which goes through the center of each of the plurality of origami units. The top arm 345 made of polylactic acid (PLA) is fixed on the top of this support post 330, and glued at the top edge of the plurality of origami units 370. The entire origami units can be rotated around its central axis by rotating the top arm 345. When the top arm 345 rotates by $2N\pi$, which is 720° in this example design, the antenna switches from its right-handed state to its left-handed state.

Referring to FIGS. 3(*a*)-3(*c*), a telescoping metal post is used as the support post 330 of the origami SHA 300. The metal post 330 has negligible effects on the radiation properties of the origami SHA 300. The height of the antenna can be changed from 70 mm to 160 mm. The origami SHA 300 can be tightly folded into a 100 mm×70 mm×5 mm volume, as shown in FIG. 8(*c*). Therefore, when the telescopic post of the support post 330 collapses, the volume of the origami SHA 300 is decreased by 96% compared to the cylindrical volume of the conventional helical antenna.

Figure 4A:
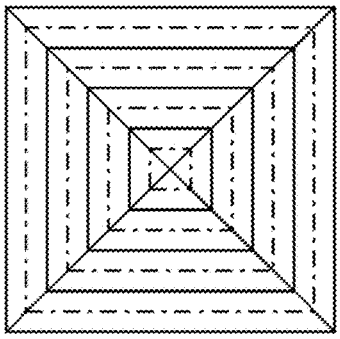
FIG. 4(*a*) shows a creased square pattern for a hyperbolic paraboloid origami.
Figure 4B:
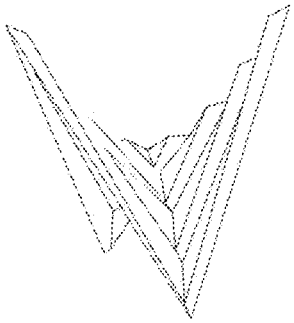

FIG. 4(*a*) shows a creased square pattern for a hyperbolic paraboloid origami, and FIG. 4(*b*) shows the hyperbolic paraboloid origami. This hyperbolic paraboloid can be created by taking a square piece of paper and folding the diagonals and concentric squares in alternating direction, i.e., a square of mountain folds depicted in FIG. 4(*a*) by the solid lines, followed by a square of valley folds depicted by the dash lines in FIG. 4(*a*), and so on. After following this process, the paper pops automatically into a saddle curve. Non-squares hyperbolic paraboloid origami structures have also been developed.

Figure 5A:
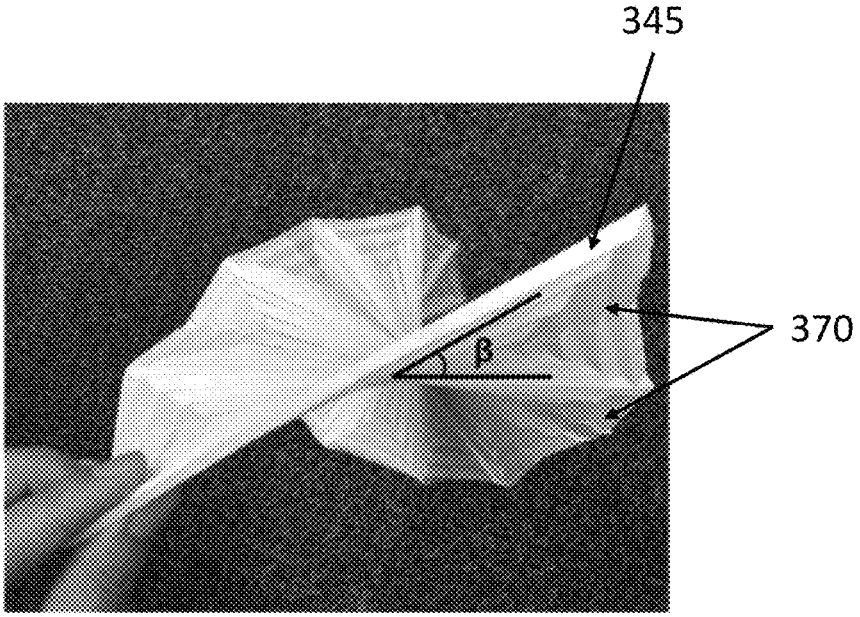
FIG. 5(*a*) shows an origami paper base that can rotate around its center axis with multiple hyperbolic paraboloid units.
Figure 5B:
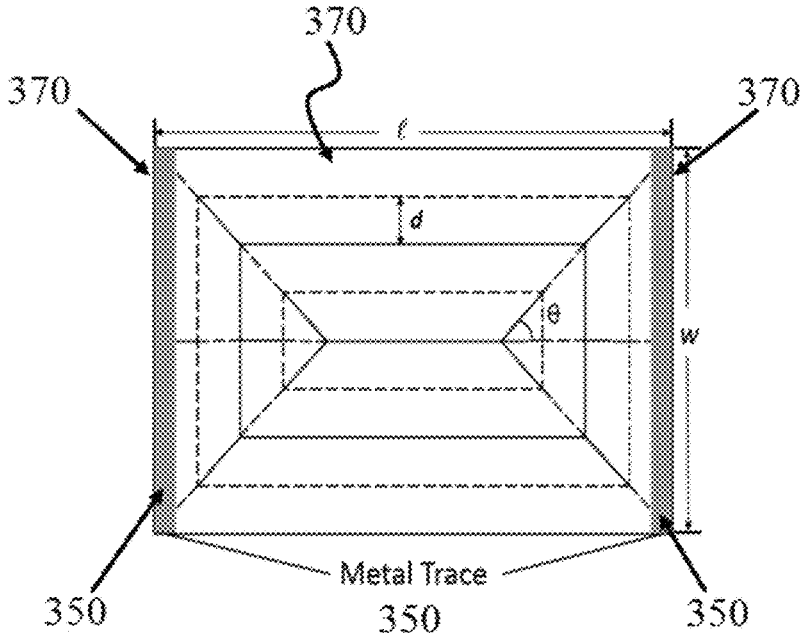
Figures 5C, 5D:
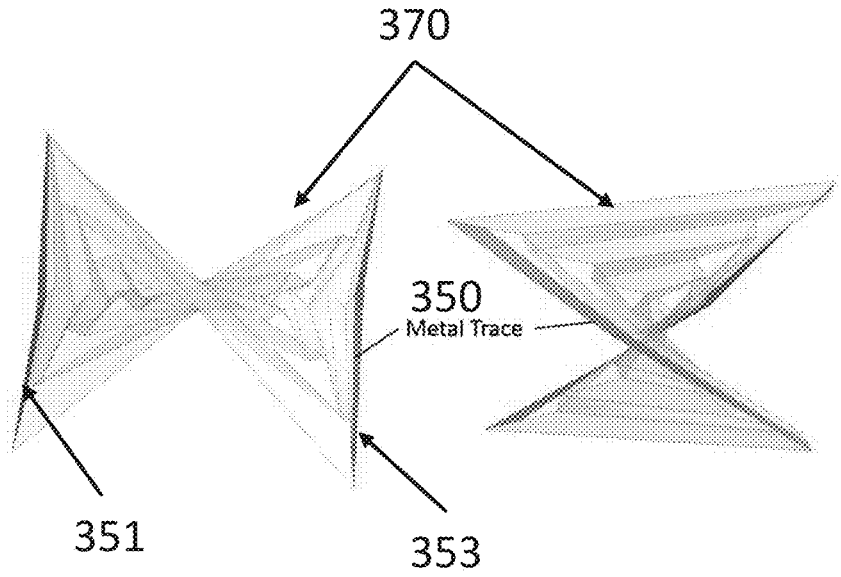

A new 3D structure can be developed by connecting several rectangle hyperbolic paraboloid origami structures in series, as shown in FIG. 5(*a*). FIG. 5(*a*) shows an origami paper base that can rotate around its center axis with multiple hyperbolic paraboloid units. This structure can be used as a base for the new origami segmented helical antenna 300 of FIGS. 2(*a*)-3(*c*) with switchable sense of polarization. This new antenna consists of a series of identical rectangle hyperbolic paraboloid origami units (i.e., the plurality of origami units 370), where the two side edges of each unit have the segmented antenna trace, as shown in FIGS. 5(*b*)-5(*c*). This new antenna has two stable states (bi-stable design): a left-handed and a right-handed state. By fixing the bottom edge of each unit and rotating its top edge, each origami unit can pop from one state to the other.

FIG. 5(*b*) shows an origami rectangle unit pattern for the hyperbolic paraboloid with antenna traces. The solid lines are mountain-folds, and the dash lines are valley-folds. The lines of each rectangle alternate from solid to dashed. The length of each origami unit 370 is l, and the width of each origami unit 370 is w. The number of rectangles in each unit is m, in FIG. 5(*b*), m=4. The distance d between the adjacent rectangles should be identical. The rotation angle β of each origami unit 370, which is shown in FIG. 5(*a*), is determined by the ratio l/w and the number m. The larger the ratio l/w is, the smaller β will be. Also, the fewer rectangles in each unit, the smaller β will be. The rectangle origami unit 370 includes a first side 371 at a left side and a second side 373 at a right side. A first metal trace 351 of the metal trace 350 is formed on the first side 371 and a second metal trace 353 of the metal trace 350 is formed on the second side 373. Thus, when the rectangle origami unit 370 is folded, the origami structure is similar to the structure of FIGS. 5(*c*) and 5(*d*) that show a top view and a side view of the rectangle hyperbolic paraboloid origami unit, respectively.

Figure 6:
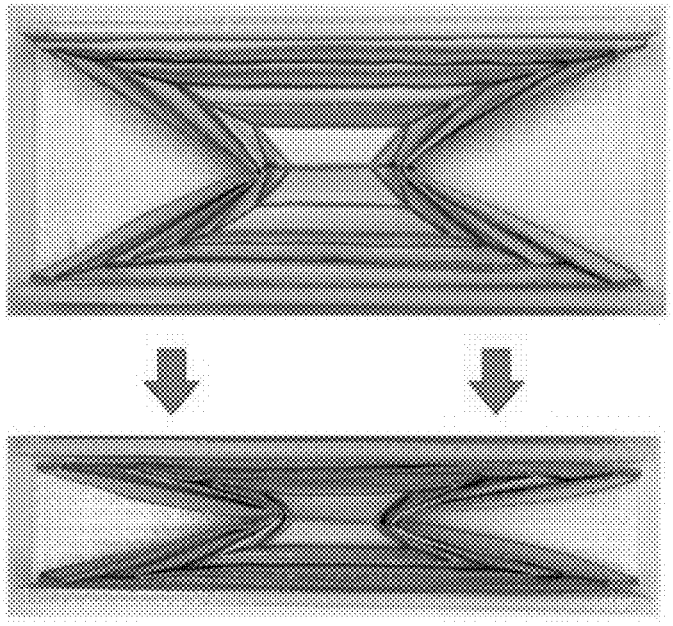
FIG. 6 shows the rectangle hyperbolic paraboloid origami unit at the compact intermediate state for stowing.
Figure 7A:
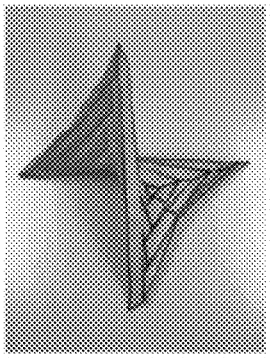
FIGS. 7(*a*)-7(*h*) show a plurality of hyperbolic paraboloid origami units.
Figure 7B:
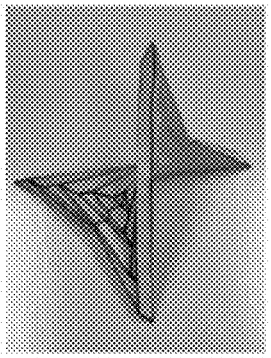
Figure 7C:
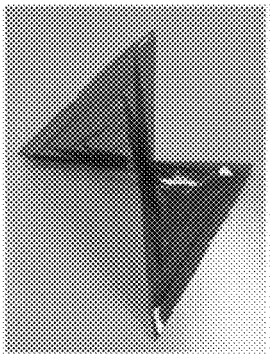
Figure 7D:
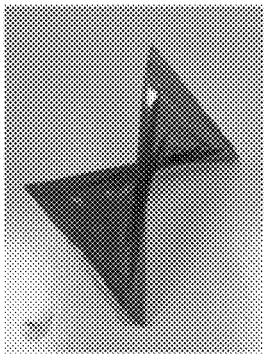
Figure 7E:
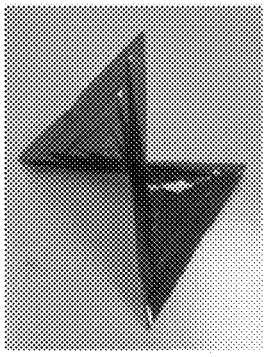
Figure 7F:
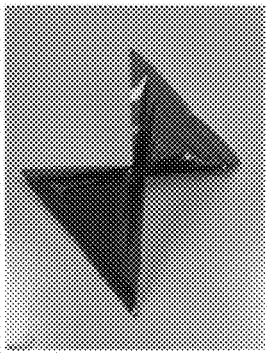
Figure 7G:
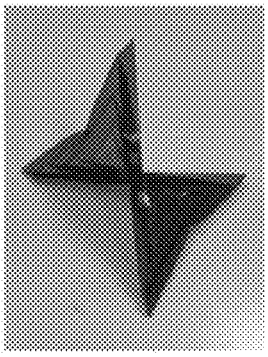
Figure 7H:
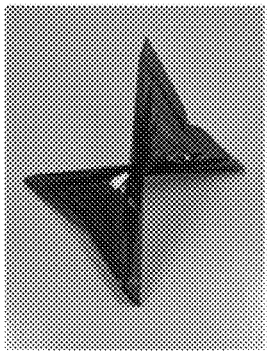
Figure 8A:
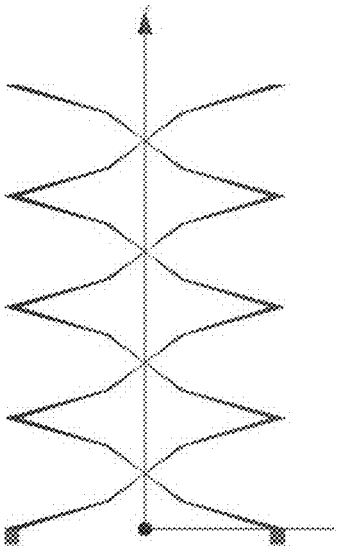
FIG. 8(*a*) shows a side view of the origami segmented helical antenna according to an embodiment of the subject invention.
Figure 8B:
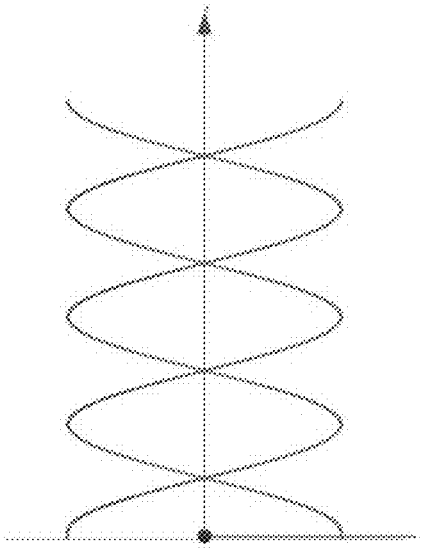
Figure 8C:
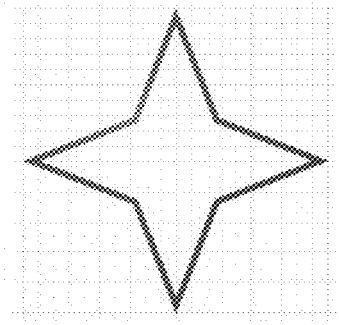
Figure 8D:
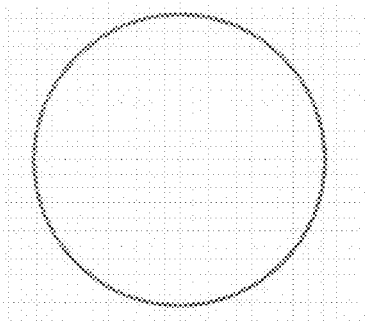
Figure 9A:
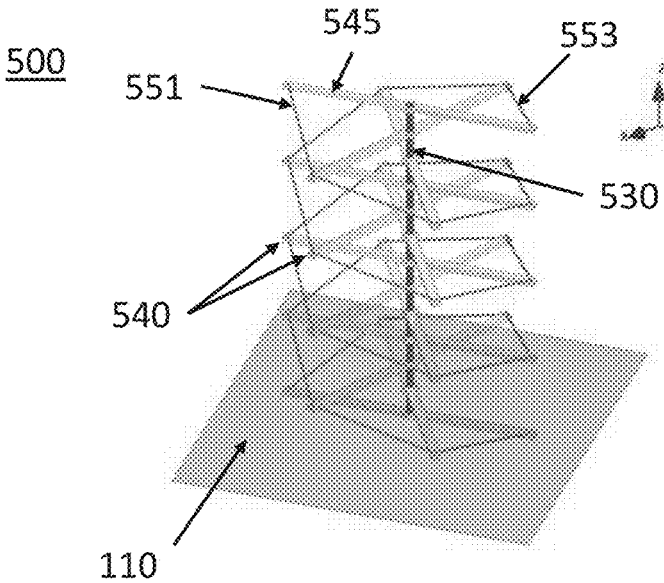
FIG. 9(*a*) shows a hexagon skeleton segmented helical antenna according to an embodiment of the subject invention at a left-handed state.
Figure 9B:
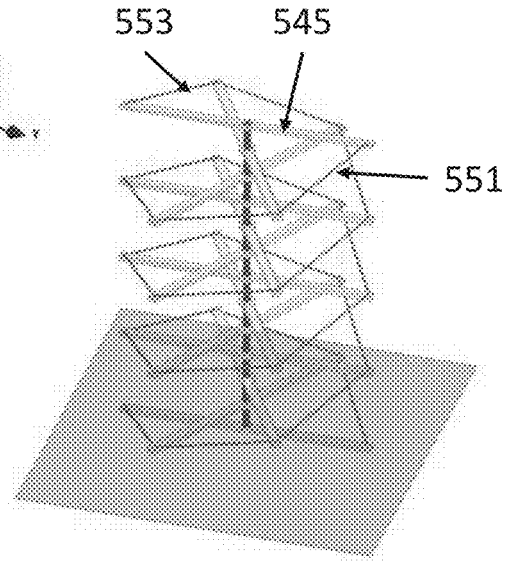
Figure 9C:
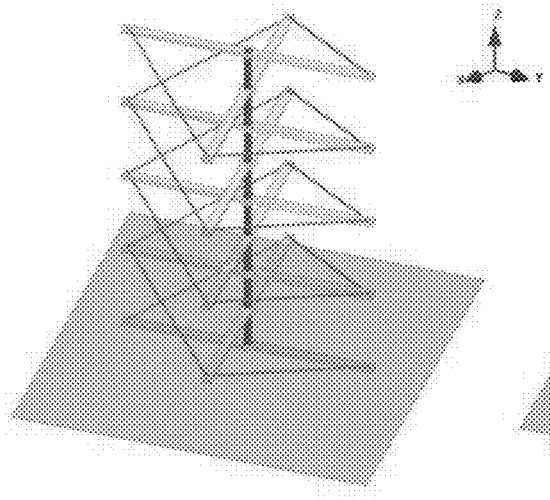
Figure 9D:
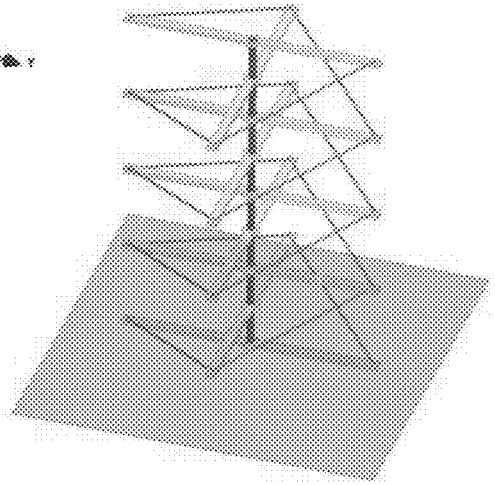

When the angle θ, shown in FIG. 5(*b*), equals 45°, the rectangle hyperbolic paraboloid origami unit can collapse its height. In this case, the origami unit can be compressed as a collapsible spring, as shown in FIG. 6 that shows the rectangle hyperbolic paraboloid origami unit at the compact intermediate state for stowing. This collapsible state of the paraboloid is not stable, but it can be used to stow the origami structure compactly and therefore it can be an intermediate non-operational state.

In the origami SHA 300 of the embodiment according to the subject invention the length, l, of the origami unit 370 equals 100 mm. Each unit has 7 rectangles and a width, w, of 84 mm. The distance, d, is 6 mm, and the height of each folded unit is approximately 20 mm. The metal trace 350 is attached along the two short sides 371 and 373 of each rectangle origami unit 370. If the paper base has n rectangle origami units, then the total length of metal trace will be nw, and the number of turns, N, of the SHA will be $$N=n\beta/2\pi \quad (1).$$

Materials with different thicknesses were tested for this origami unit. The origami base must be thick enough to mechanically support the hyperbolic paraboloid structure, but if it becomes too thick it will not be foldable.

FIG. 7(*a*)-7(*h*) show the rectangle hyperbolic paraboloid origami unit for the left-handed and right-handed states for different materials (paper and Kapton®) and different thicknesses. The thickness of the material has a small effect on the rotation angle β. The thicker the material is, the smaller β will be. The applicable thickness range for the commercially available paper without any coating is from 100 μm to 400 μm. In an embodiment, 100 μm-thick paper can be used as the origami base. The rotation angle, β, of the 100 μm-thick paper origami unit is approximately 90°. The origami units that were built with Kapton® FPC film exhibit similar properties compared to the paper base. The applicable thickness range for the Kapton films is from 50 μm to 150 μm. The 2 mil-thick Kapton unit, shown in FIGS. 7(*c*) and 7(*d*), has the biggest rotation angle β. The 5 mil-thick Kapton unit, shown in FIGS. 7(*g*) and 7(*h*), has the most stable structure.

An origami Segmented Helical Antenna (SHA) 300 of embodiments of the subject invention can be developed using multiple connected in series rectangle hyperbolic paraboloid origami units 370, which were discussed above. This origami geometry will allow a right-handed SHA to be switched to a left-handed SHA by rotating all its origami units clockwise and the left-handed SHA to be switched back to the right-handed SHA by rotating all its origami units counterclockwise. Therefore, this origami SHA 300 can provide a switchable sense of polarization.

FIGS. 8(*a*)-8(*d*) show the side and top views of the origami SHA and the conventional HA. The origami paper base is not shown in FIGS. 8(*a*)-8(*d*) in order to clearly show the metal trace functioning as an antenna. The blue and red strips in FIGS. 8(*a*) and 8(*c*) are the two metal traces 351 and 353 of the origami SHA 300. Each metal trace is connected to a 50 ohm excitation. The two excitation ports have 180° phase difference. A 150 mm by 150 mm ground plane can be used. This origami SHA can include eight origami rectangle units (n=8). The rotation angle, β, of each origami unit can be 90°. The number of turns, N, of this SHA can be calculated from equation (1), which is two. The total height of the origami antenna is 160 mm, and the length of each metal strip is 672 mm. FIG. 8(*c*) shows that the cross section of this SHA is a symmetrical polygon with 8 edges. The length of each edge is 42 mm, which is half of the width of the origami unit. The pitch angle, α, of the origami SHA can be calculated by:

$$\alpha = \tan^{-1}\left(\frac{\text{Antenna Height}}{n \times w}\right), \quad (2)$$

which is 13.4°. The conventional HA 100, shown in FIGS. 8(*b*) and 8(*d*), also has two turns. The circumference of the conventional HA is πl. The spacing, S, between each turn is 80 mm. Therefore, the pitch angle α for the conventional HA is calculated as 14.2°.

FIGS. 9(*a*)-9(*d*) show a skeleton segmented helical antenna according to an embodiment of the subject invention. In particular, FIG. 9(*a*) shows a hexagon skeleton segmented helical antenna according to an embodiment of the subject invention at a left-handed state and FIG. 9(*b*) shows the hexagon skeleton segmented helical antenna according to an embodiment of the subject invention at a right-handed state. FIG. 9(*c*) shows a square skeleton segmented helical antenna according to an embodiment of the subject invention at a left-handed state, and FIG. 9(*d*) shows the square skeleton segmented helical antenna at a right-handed state.

Referring to FIGS. 9(*a*)-9(*d*), the skeleton scaffolding segmented helical antenna (SHA) 500 comprises a plurality of unit arms 540 having a center hole 547, a first end hole 541, and a second end hole 543, a central axis 530 passing through the center hole 547 of the plurality of unit arms 540, a first wire 551 passing through the first end hole 541, and a second wire 553 passing through the second end hole 543. The central axis 530 stands on the base 110, thereby serving a center support post. The plurality of unit arms 540 is rotatable and thus, when the plurality of unit arm 540 rotate, the first wire 551 and the second wire 553 also rotate clockwise or counterclockwise. When a next unit arm is rotated at 60° with respect to a previous unit arm, the first wire 551 and the second wire 553 form a hexagonal shape when view from a top, thereby forming a hexagonal skeleton SHA, as shown in FIGS. 9(*a*) and 9(*b*). When a next unit arm is rotated at 90° with respect to a previous unit arm, the first wire 551 and the second wire 553 form a square shape when view from a top, thereby forming a square skeleton SHA, as shown in FIGS. 9(*c*) and 9(*d*). By rotating a top arm 545 of the plurality of unit arm 540, the skeleton SHA 500 changes the state from the left-handed state of FIG. 9(*a*) to the right-handed state of FIG. 9(*b*) or from the right-handed state of FIG. 9(*b*) to the left-handed state of FIG. 9(*a*).

Figure 10:
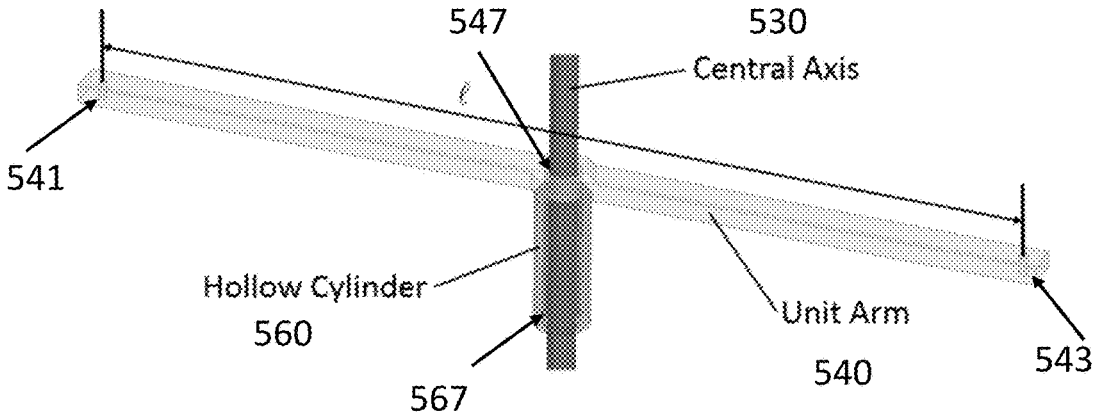
FIG. 10 shows a unit of skeleton segmented helical antenna according to an embodiment of the subject invention.

FIG. 10 shows a unit of skeleton segmented helical antenna. Referring to FIGS. 9(*a*)-(*d*) and 10, the skeleton scaffolding SHA 500 can include a hollow cylinder 560 disposed between the plurality of unit arms 540, wherein the central axis 530 passes through a hollow center hole 567. The hollow cylinder 560 supports the unit arm 540 and maintains a distance between the adjacent unit arms 540. The unit arm 540 is supported by the central axis 530 through the center hole 547, thereby can rotate with respect to the central axis 530. The unit arm 540 is configured to have the first end hole 541 and the second end hole 543 such that the first wire 551 and second wire 553 pass through the end holes 541 and 543.

The central axis 530 goes through the center hole 547 of the unit arm 540, and the unit arm 540 can rotate around this central axis 530. The first wire 551 and second wire 553 (e.g., made of a copper wire) feed through these end holes to construct the segmented helix. The hollow cylinder 560, which controls the unit height, is placed around the central axis 530 between two adjacent arms. The unit arm 540 and the hollow cylinder 560 can slide up and down along the central axis 530. The distance between the two end holes of the unit arm 540 is denoted as l, which is geometrically equivalent to the length of the origami unit presented in the origami SHA. It also equals the length of the diagonal line of the segmented helix's cross section. The height of each unit is denoted as h. The thickness of the arm is denoted as $t_1$, which determines the minimum volume of this antenna when it is collapsed (the collapsible skeleton SHA is presented in next section). The range of the rotation angle β between adjacent arms is between 0° to 180°.

Two different types of skeleton SHAs have been discussed for exemplary purposes: a hexagon skeleton SHA; and a square skeleton SHA. Both SHAs have the same geometrical size as the origami SHA presented in the previous section. The length, l, of the arm can be 100 mm, and the total height of the antenna can be 160 mm. Their final structures are shown in FIGS. 9(*a*)-9(*d*) for both the right-handed and left-handed states. Both SHAs have a total of 2 turns. The length and height dimensions, number of turns, and other specifics provided throughout are for exemplary purposes only and should not be construed as limiting.

Referring to FIGS. 9-10, the thickness of each unit arm 540 is 2 mm and copper wire with 0.4 mm diameter feeds through a hole at one end of one arm and through the hole at the end of the next arm. The symmetrical bifilar segmented helix structure is built with the skeleton arms. Each copper wire of the first wire 551 and second wire 553 is connected at the base of the antenna to a 50 ohm excitation, and the other end of each copper wire is fixed on the top arm 545. The two excitation ports have 180° phase difference. A 150 mm by 150 mm square copper sheet can be used as the ground plane. The skeleton SHA has two states: right-handed state and left-handed state. A right-handed skeleton SHA can be switched to a left-handed skeleton SHA by rotating the top arm 545 by 720° (two turns), while all the rest arms are dragged by the copper wire and rotate to the positions of the left-handed state.

FIG. 23 shows the geometric parameters of the hexagon and square skeleton SHAs that are shown in FIGS. 9(*a*)-9(*d*). The square skeleton SHA has fewer arms, larger unit height and shorter copper wire length compared to the hexagon skeleton SHA. The pitch angle, a, of these two skeleton SHAs can be calculated by equation (2). The performance of the two antennas is examined in the next section.

Figures 11A, 11B:
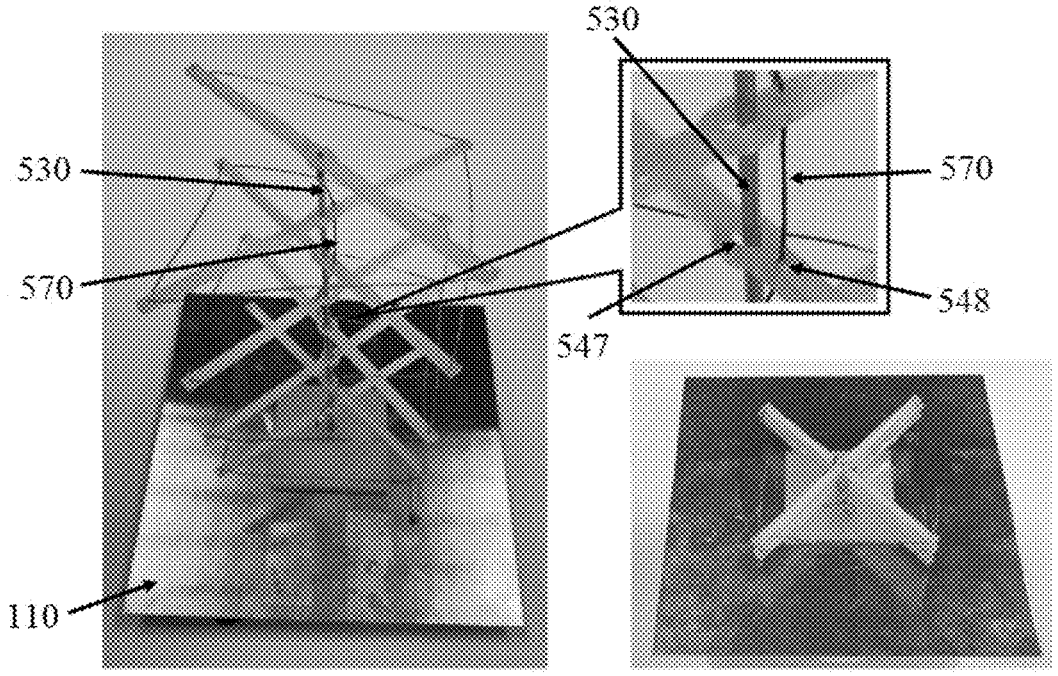
FIG. 11(*a*) shows a deployable skeleton segmented helical antenna according to an embodiment of the subject invention.

The skeleton based SHA is also a collapsible and deployable antenna like the origami SHA 300 of FIGS. 2 and 3. FIG. 11(*a*) shows a deployable skeleton segmented helical antenna according to an embodiment of the subject invention, and FIG. 11(*b*) shows the compressed deployable skeleton segmented helical antenna. Specifically, the hollow cylinders between the unit arms were removed and an additional hole was in each unit arm. Referring to FIGS. 11(*a*) and 11(*b*), each unit arm includes a thread hole 548 adjacent to the center hole 547 and a thread 570 is fixed on the unit arm through the thread hole 548. The position of the thread hole 548 is close to the central axis 530. A nonconductive thread 570 is fed through the thread holes 548, and the thread 570 is fixed on each arm. The thread 570 pulls the arms upward sliding them along a post of the central axis 530 when the antenna is expanded, and it also sets the distance between adjacent arms. A telescoping metal post can be used as the central axis 530. This design structure allows the antenna arms to rotate and the antenna to collapse or expand its height. The minimum collapsed height of this skeleton SHA, shown in FIG. 11(*b*), is approximately 17 mm, which make the antenna occupy 90% smaller volume compared to the volume of the completely expanded SHA. This is very useful for satellite antenna systems, where the SHA can be collapsed and stowed compactly during launch while it can expand when it reaches space.

In the embodiments of the subject invention, bifilar segmented helical antennas with switchable sense of polarization can be used based on origami SHA 300 and skeleton scaffolding SHA 500. Both SHAs exhibit high directional gain as conventional helical antennas. Both SHAs are circular polarized with small axial ratios (below 1.2 dB). The sense of the circular polarization of the SHAs can be switched from LHCP to RHCP by mechanical rotation around their central axis. Also, the SHAs can collapse to achieve high packaging ratios, which is very useful for satellite systems and in particular small satellites, e.g., CubeSats.

Figure 12A:
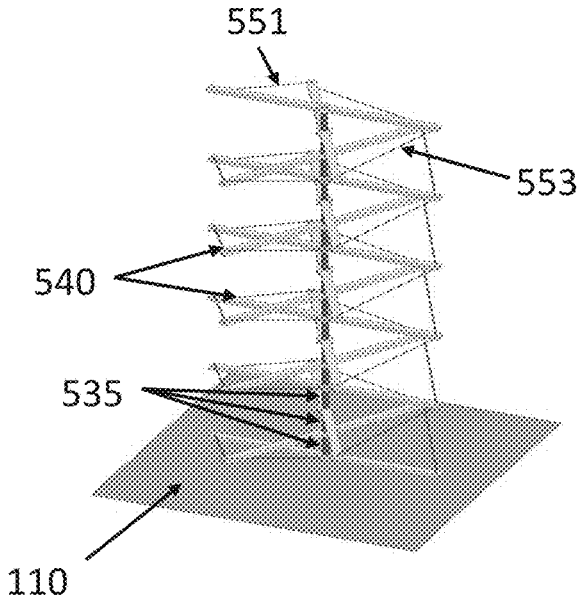
FIG. 12(*a*) shows a segmented helical antenna according to an embodiment of the subject invention at right-handed state.
Figure 12B:
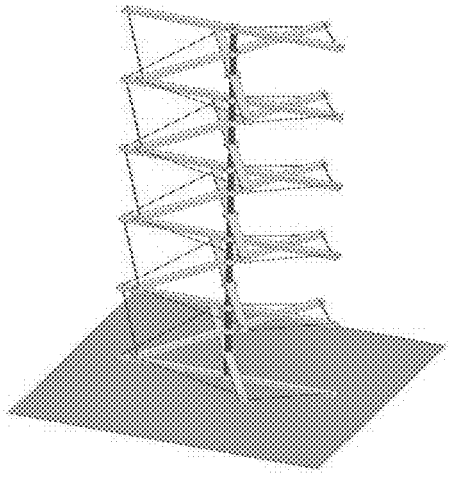
Figure 13A:
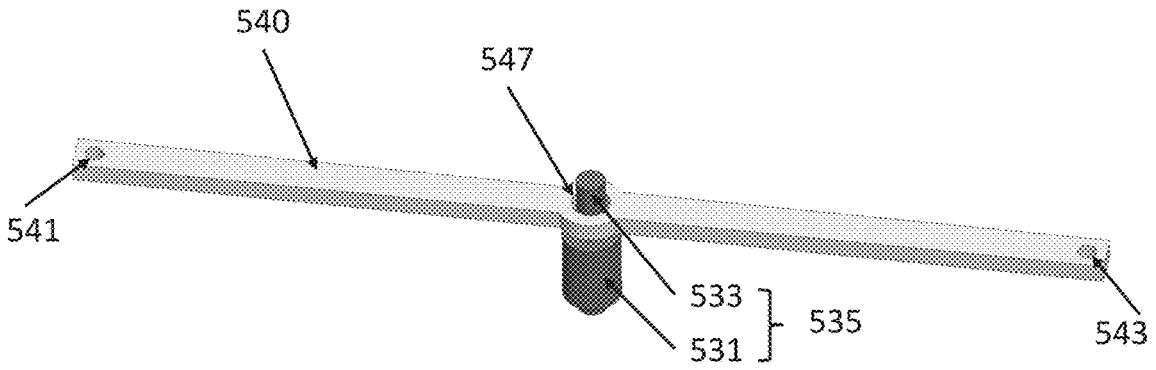
FIG. 13(*a*) shows a unit of the segmented helical antenna according to an embodiment of the subject invention.
Figure 13B:
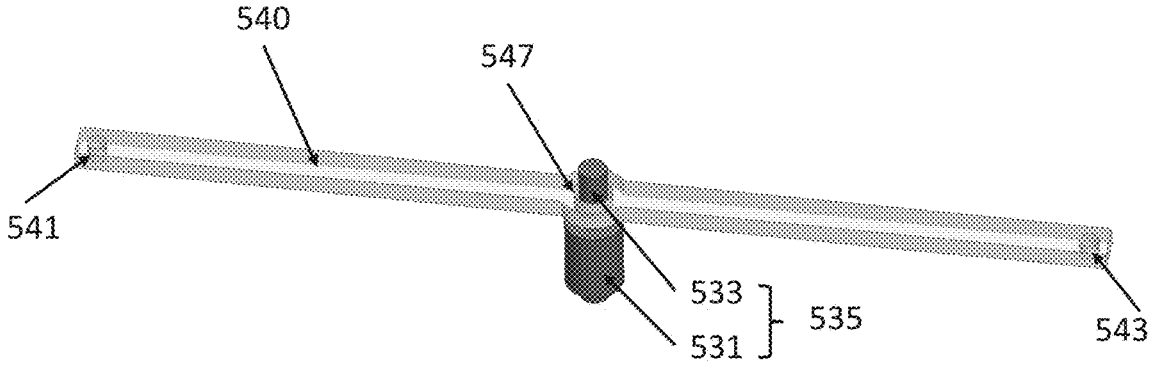

FIGS. 12(*a*)-13(*b*) show a segmented helical antenna (SHA) according to an embodiment of the subject invention. FIG. 12(*a*) shows a segmented helical antenna at a right-handed state, and FIG. 12(*b*) shows the segmented helical antenna at a left-handed state. FIG. 13(*a*) shows a unit of the segmented helical antenna, and FIG. 13(*b*) shows a transparent view of the unit of the segmented helical antenna.

Referring to FIGS. 12(*a*)-13(*b*), the SHA comprises a plurality of unit arms 540 having a center hole 547, a first end hole 541, and a second end hole 543, a plurality of posts 535 disposed between the plurality of unit arms 540, a first wire 551 passing through the first end hole 541 of each of the plurality of unit arms 540, and a second wire 553 passing through the second end hole 543 of each of the plurality of unit arms 540. Each of the plurality of posts 535 comprises a first portion 531 supporting the unit arm 540 and a second portion 533 passing through the center hole 547 of the unit arm 540. Thus, each of the plurality of unit arms 540 and each of the plurality of posts 535 are capable of assembling and disassembling.

The distance between the first end hole 541 and the second end hole 543 can be, for example, 100 mm. The thickness of the unit arm 540 can be 2 mm, and the distance between each arm can be 10 mm. The wire (e.g., copper wire) for the first wire 551 and the second wire 553 can have a 0.3 mm radius and goes through the hole at one end of the arm to the next unit, as shown in FIG. 12(*a*).

Referring to FIGS. 12(*a*) and 12(*b*), the state can be switched by rotating all the arms of the skeleton. The bifilar helix structure is used in this embodiment, which will balance the horizontal position of the arms. The bifilar helical antenna of the embodiment has better gain and lower beam-width compare with the single helix antenna. One copper wire of the first wire 551 and the second wire 553 is connected to a 50 ohms SMA connector, and the other copper wire is directly connected to the ground. A 150 mm by 150 mm copper sheet can be used as the ground plane.

Figure 14:
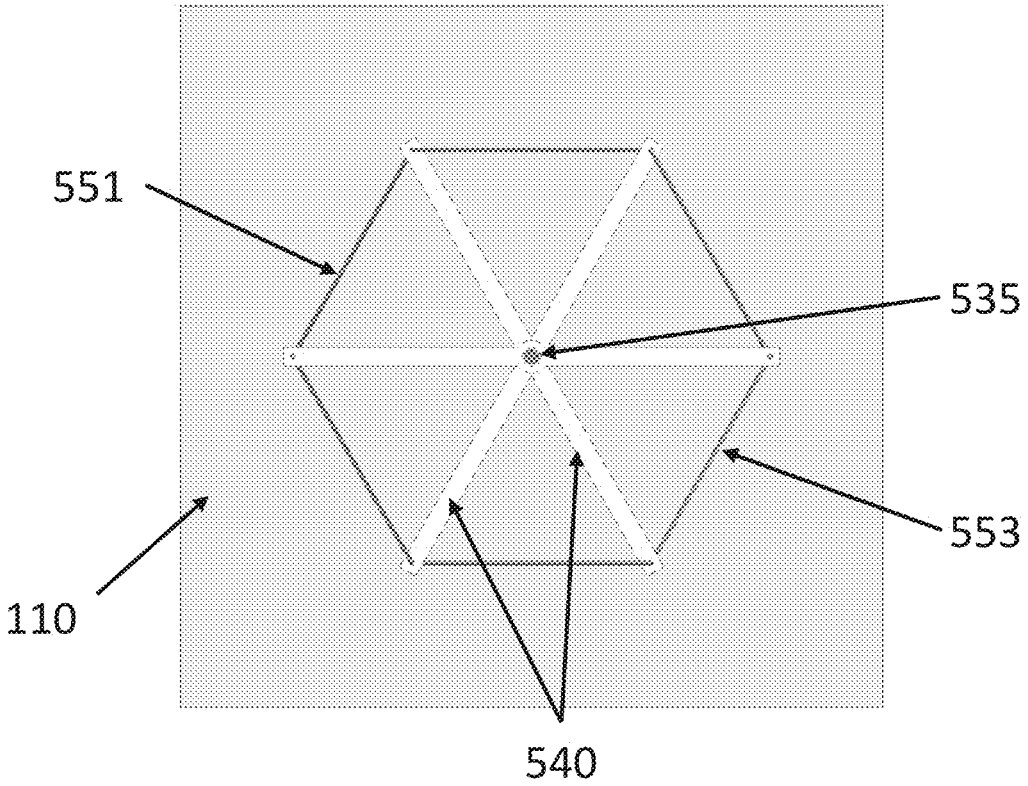
FIG. 14 shows a top view of the segmented helical antenna according to an embodiment of the subject invention.

FIG. 14 shows a top view of the segmented helical antenna. Referring to FIGS. 12-14, the rotation angle between the adjacent arms is 60°, the SHA has 16 arms, and each wire has 15 segments. Every six segments construct a whole turn, and the helical antenna has 2.5 turns in total. The antenna has a hexagon shape when viewing from top, as shown in FIG. 14. The spacing between each turn is 6×12 mm=72 mm. The length of each of the copper wire is approximately 54 mm. The pitch angle of this helical antenna can be calculated:

$$\tan^{-1}\left(\frac{72\text{ mm}}{54\text{ mm}\times 6}\right) \approx 12.5^\circ \tag{3}$$

The subject invention includes, but is not limited to, the following exemplified embodiments.

Embodiment 1

A segmented helical antenna, comprising:

a plurality of origami units having a plurality of metal traces;

a support post passing through the plurality of origami units; and an arm disposed on a top of the support post and attached (e.g., glued) on a top edge of the plurality of origami units, wherein the plurality of origami units is configured to be rotatable with the arm such that the plurality of metal traces extends in a clockwise direction or in a counterclockwise direction.

Embodiment 2

The segmented helical antenna according to embodiment 1, wherein each of the plurality of origami units includes a first metal trace and a second metal trace of the plurality of metal traces respectively on a first side and a second side thereof.

Embodiment 3

The segmented helical antenna according to embodiment 2, wherein each of the plurality of origami units has a rectangle unit, and the first side and the second side are a left side and a right side, respectively, of the rectangle unit.

Embodiment 4

The segmented helical antenna according to any of embodiments 1-3, wherein the plurality of origami units is made of paper or a polyimide film.

Embodiment 5

The segmented helical antenna according to any of embodiments 1-4, wherein the support post is configured to be collapsible.

Embodiment 6

The segmented helical antenna according to any of embodiments 1-5, wherein the plurality of metal traces is made of copper.

Embodiment 7

A segmented helical antenna, comprising:

a plurality of unit arms, each of plurality of unit arms having a center hole, a first end hole, and a second end hole;

a central axis passing through the center holes of the plurality of unit arms;

a first wire passing through the first end hole of each of the plurality of unit arms; and a second wire passing through the second end hole of each of the plurality of unit arms, wherein each of the plurality of unit arms is configured to be rotatable such that the first wire and the second wire rotate clockwise or counterclockwise.

Embodiment 8

The segmented helical antenna according to embodiment 7, further comprising a hollow cylinder disposed between the plurality of unit arms.

Embodiment 9

The segmented helical antenna according to embodiment 8, wherein the central axis passes through the hollow cylinder.

Embodiment 10

The segmented helical antenna according to any of embodiments 7-9, wherein the plurality of unit arms are arranged such that the first wire and the second wire form a square shape or a hexagon shape when viewed from a top of the segmented helical antenna.

Embodiment 11

The segmented helical antenna according to any of embodiments 7-10, wherein one end of each of the first wire and the second wire is connected to a 50 ohm excitation and the other end of each of the first wire and the second wire is fixed on a top arm of the plurality of unit arms.

Embodiment 12

The segmented helical antenna according to embodiment 11, wherein each of the plurality of unit arms is arranged to form a right-handed state or a left-handed state, and the right-handed state and the left-handed state are switched to each other by rotating the top arm of the plurality of unit arms.

Embodiment 13

The segmented helical antenna according to embodiment 7, further comprising a thread, wherein each of the plurality of unit arms includes a thread hole adjacent to the center hole, and the thread is fixed on each of the plurality of unit arms through the thread hole.

Embodiment 14

The segmented helical antenna according to embodiment 13, wherein the thread is configured to pull the plurality of unit arms upward along the central axis.

Embodiment 15

The segmented helical antenna according to any of embodiments 13 and 14, wherein the central axis is a telescoping metal post.

Embodiment 16

A segmented helical antenna, comprising:

a plurality of unit arms, each of plurality of unit arms having a center hole, a first end hole, and a second end hole;

a plurality of posts disposed between the plurality of unit arms;

a first wire passing through the first end hole of each of the plurality of unit arms; and a second wire passing through the second end hole of each of the plurality of unit arms, wherein each of the plurality of posts includes a first portion supporting the plurality of unit arms and a second portion passing through the center hole of the plurality of unit arms, and wherein each of the plurality of unit arms is rotatable.

Embodiment 17

The segmented helical antenna according to embodiment 16, wherein the first wire is connected to a 50 ohm connector and the second wire is connected to a ground.

Embodiment 18

The segmented helical antenna according to any of embodiments 16 and 17, wherein the plurality of unit arms is configured to mechanically rotate such that a right-handed state and a left-handed state are switchable by rotating the plurality of unit arms.

Embodiment 19

The segmented helical antenna according to any of embodiments 17 and 18, further comprising a copper sheet function as the ground.

Embodiment 20

The segmented helical antenna according to any of embodiments 16-19, wherein the first wire and the second wire are made of a copper.

A greater understanding of the present invention and of its many advantages may be had from the following example, given by way of illustration. The following example is illustrative of some of the methods, applications, embodiments, and variants of the present invention. It is, of course, not to be considered as limiting the invention. Numerous changes and modifications can be made with respect to the invention.

Example 1

Figure 15:
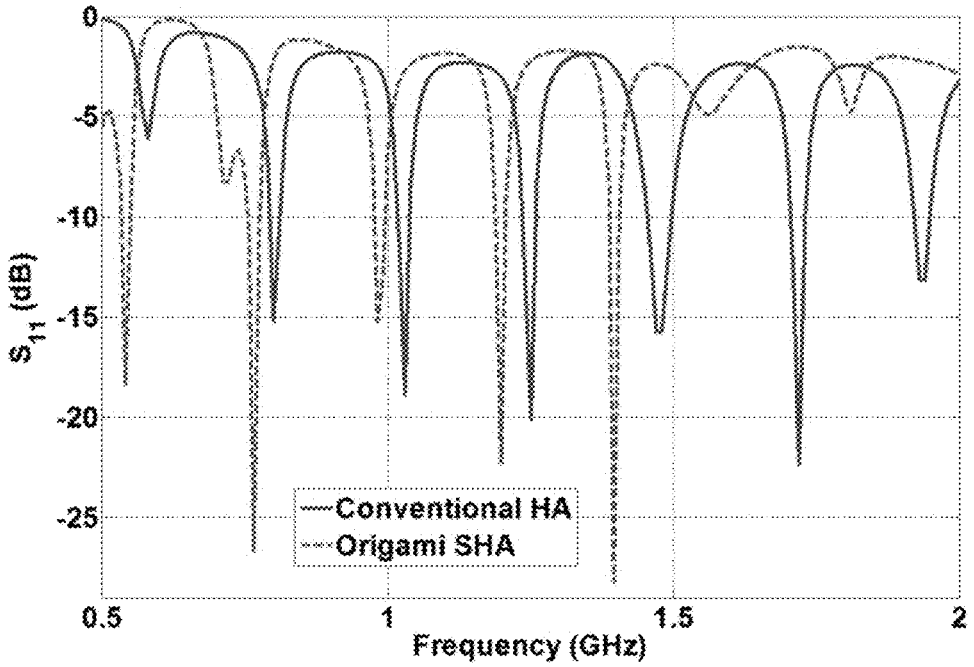
FIG. 15 shows a simulated S11 of the convention helical antenna and the origami segmented helical antenna according to an embodiment of the subject invention.

FIG. 15 shows a simulated reflection coefficient S11 of the convention helical antenna 100 and the origami segmented helical antenna 300 according to an embodiment of the subject invention. It can be observed that the two curves are similar, and both antennas have several resonant frequencies. That is, the origami SHA 300 according to an embodiment can change from the RHCP antenna to the LHCP antenna or vice versa and reduce the total bulk by collapsing the origami while remaining the antenna performance.

Figure 16:
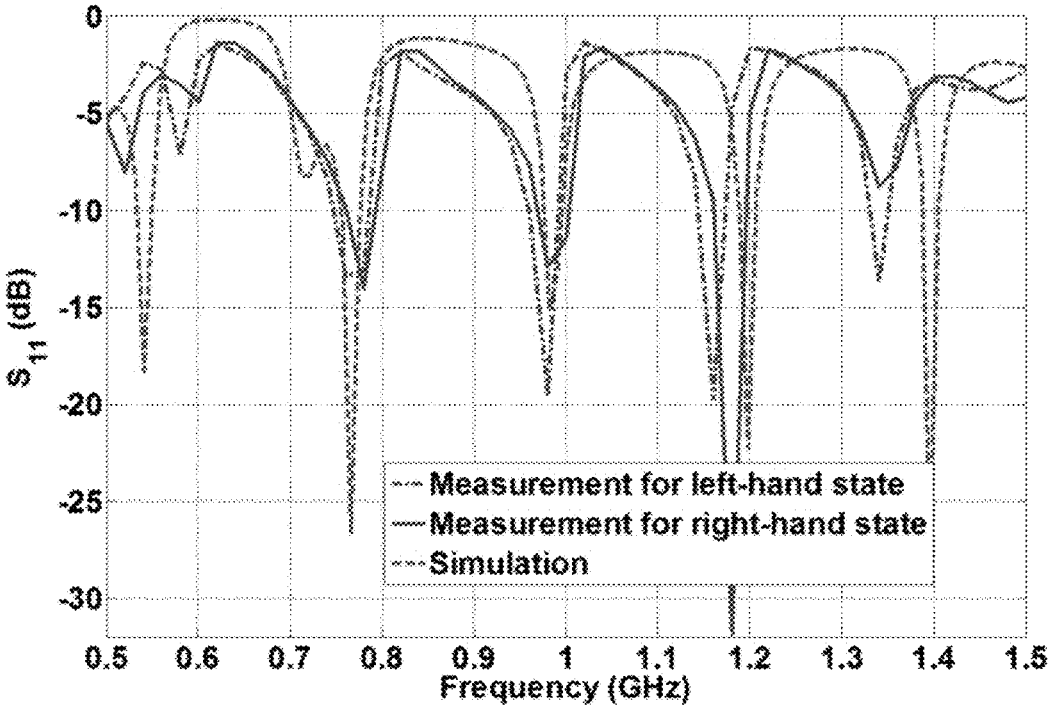
FIG. 16 shows a measured S11 of the origami segmented helical antenna according to an embodiment of the subject invention at both left-handed state and right-handed state and a simulated S11.
Figure 17A:
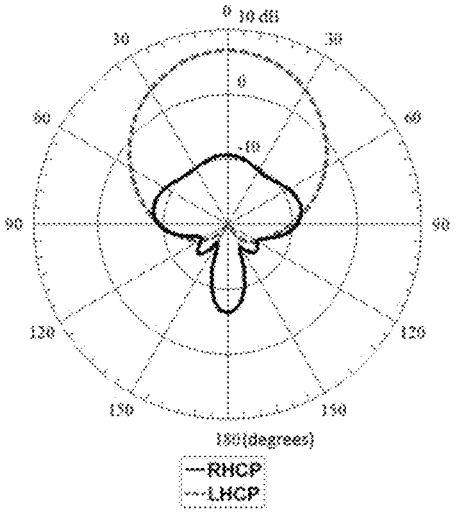
FIG. 17(*a*) shows measured the right-hand circular polarization (RHCP) and left-hand circular polarization (LHCP) elevation patterns of the origami segmented helical antenna according to an embodiment of the subject invention at φ=0°, at the left-handed state, and at 0.98 GHz.
Figure 17B:
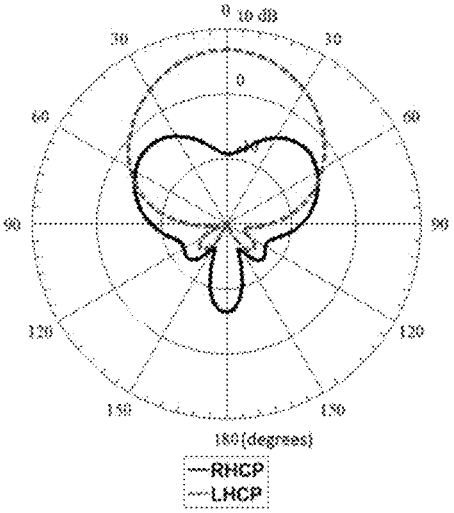
Figure 17C:
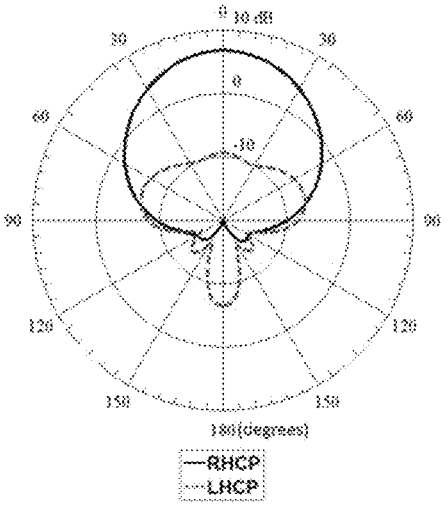
Figure 17D:
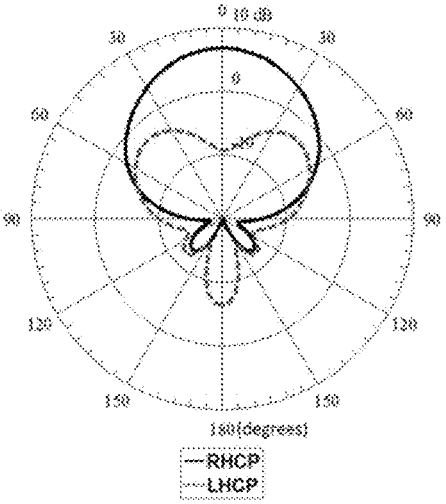

FIG. 16 shows a measured reflection coefficient S11 of the origami segmented helical antenna according to an embodiment of the subject invention at both left-handed state and right-handed state and a simulated S11. It can be seen, the two states have almost identical measured $S_{11}$-parameters and both measurements agree well with the simulation results. The slight disagreement between the measured and simulated reflection coefficient is due to the fact that the simulated origami antenna is based on an ideal centrosymmetric model, which cannot be exactly realized by the prototype, since it was built manually. Also, the slight differences between the measured S11-parameters for the two states can be attributed to the fact that the origami paper base is constructed manually and, therefore, the geometries of the two states are not identical.

FIG. 16 shows that the origami SHA has four resonant frequencies from 0.77 GHz to 1.34 GHz. Also, this SHA exhibits directional gain performance at these frequencies as shown in FIGS. 17(*a*)-17(*d*). FIG. 24 shows the measured far-field performance metrics of the origami SHA 300 of an embodiment at the four frequencies. The far-field measurements were performed using a StarLab anechoic chamber. The results illustrate that the origami SHA 300 has the best axial ratio (0.94 dB) and highest co-polarization realized gain (6.82 dBi) at 0.98 GHz.

FIGS. 17(*a*)-17(*d*) show the measured RHCP and LHCP elevation pattern of the origami SHA for $\varphi=0°$ and $\varphi=90°$ for both the left-handed and the right-handed states at 0.98 GHz. FIG. 17 illustrates that the origami SHA works in the axial mode, and the maximum gain is along its central axis. The level of cross-polarization gain is approximately 16 dB lower than the co-polarization gain over the main beam direction. The shapes of the radiation patterns at the two states are almost identical. The sense of polarization of this origami SHA can be switched from RHCP and LHCP by rotating the antenna around its axis to change the right-handed helix to a left-handed helix thereby providing a reconfigurable polarization.

Figure 18A:
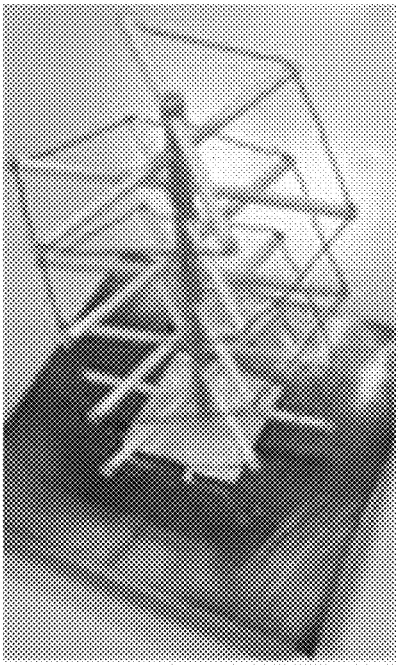
FIG. 18(*a*) shows a manufactured hexagon skeleton segmented helical antenna according to an embodiment of the subject invention.
Figure 18B:
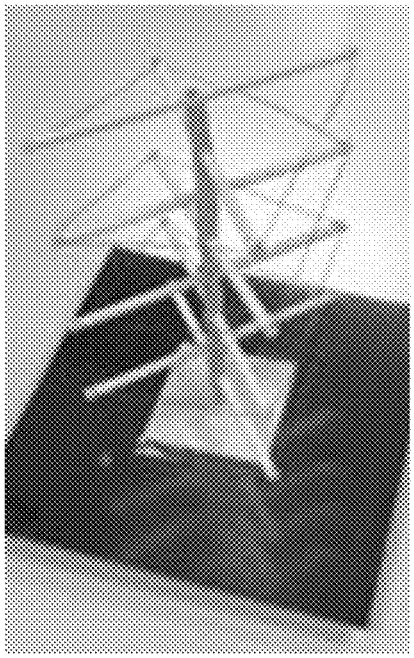
Figure 19A:
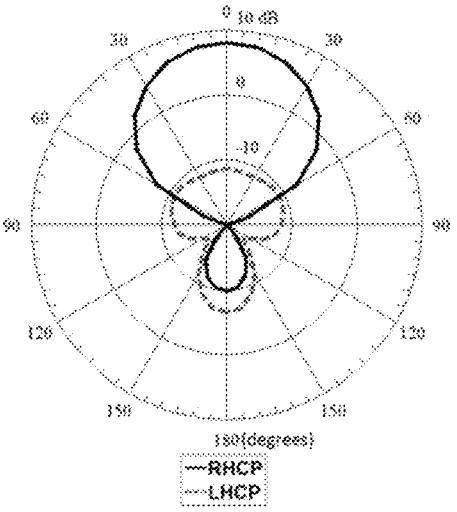
FIG. 19(*a*) shows measured elevation patterns for RHCP and LHCP components of the electric field of the hexagon skeleton segmented helical antenna for φ=0° at the right-handed state.
Figure 19B:
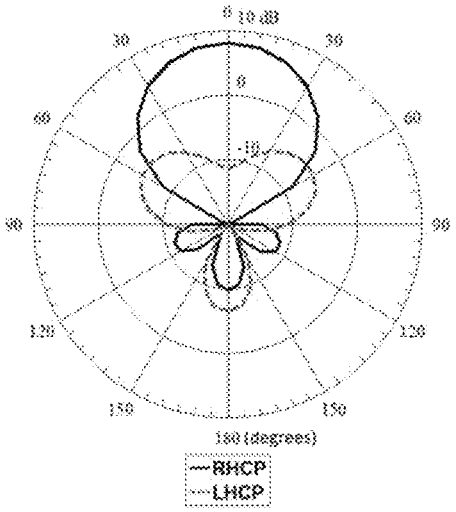
Figure 19C:
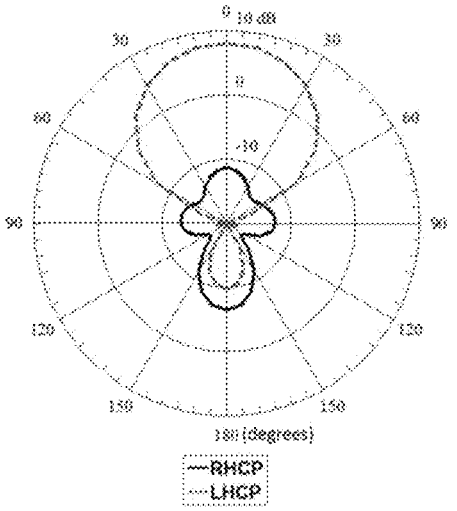
Figure 19D:
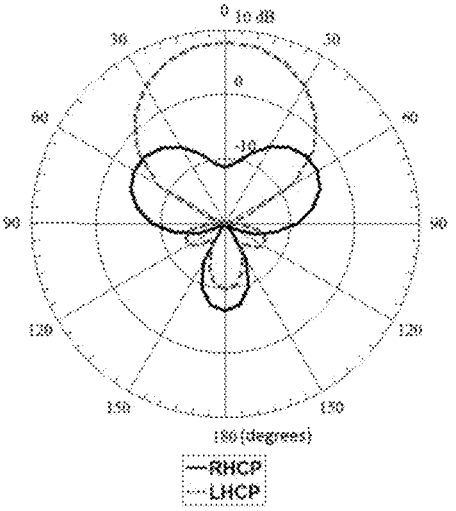
Figure 19E:
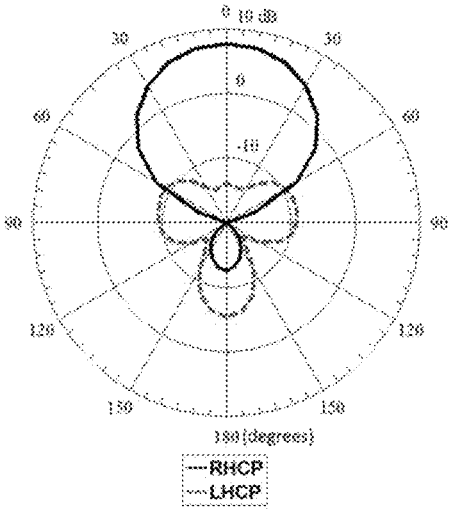
Figure 19F:
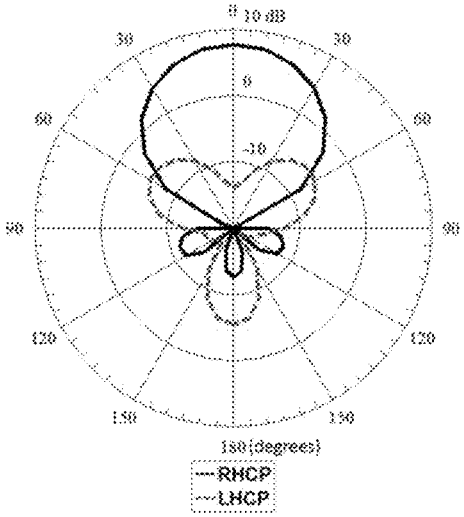
Figure 19G:
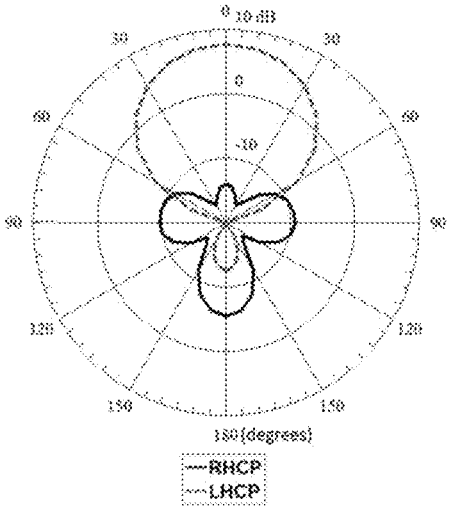
Figure 19H:
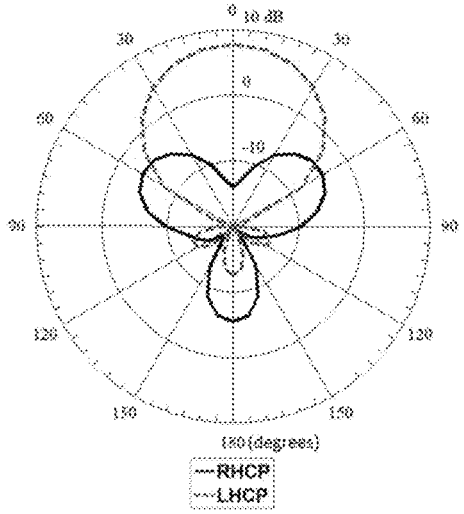

Prototypes of the two skeleton SHAs with the geometric parameters of FIG. 23 were built. FIGS. 18(*a*) and 18(*b*) show the prototypes of the manufactured hexagonal skeleton SHA and the manufactured square skeleton SHA according to an embodiment of the subject invention. The central axis, hollow cylinder, and arms of the skeleton scaffolding were printed with PLA filament using a 3D printer. The dielectric constant of the PLA is 2.5. The copper 26-gauge wire (0.409 mm diameter) used in the prototype is magnet wire with polyester coating. The thickness of the insulation layer is 0.023 mm. The two segmented helical elements of each SHA antenna are fed using SMA connectors and with 180° phase difference between them. When the top arm rotates 720°, the entire segmented helical structure will rotate from its right-handed state to left-handed state.

The measured performance characteristics of the proposed skeleton SHAs are compared with the ones of the origami SHA and the equivalent conventional bifilar HA in FIG. 25. All the antennas have the same diameter, height, and number of turns. The operating frequency of each antenna is picked so that it operates in axial mode and with the best axial ratio. From the results in FIG. 25, it can be concluded that all the SHAs have CP performance with small axial ratio (below 1.2 dB). The origami SHA has 1.4 dB lower gain, larger axial ratio and wider beamwidth than the corresponding ones of the conventional HA. The half-power beamwidths (HPBWs) of the radiation pattern of the two skeleton SHAs are approximately the same to the ones of the conventional HA. The two skeleton SHAs have slightly lower realized gain and slightly larger axial ratio compared to the ones of the conventional HA. Also, since the circumference of the hexagon skeleton SHA has more sides than that of the square skeleton SHA, the hexagon skeleton SHA is geometrically more similar to the conventional HA and therefore, it is expected that the axial ratio and gain performances of the hexagon skeleton SHA will be more similar to the ones of the conventional SHA. The operating frequency of the origami SHA is approximately the same to the operating frequency of the conventional HA. Whereas, the operating frequencies of the skeleton SHAs are slightly higher than the operating frequency of the conventional HA. This happens because the circumference of the skeleton SHAs are smaller than the circumference of the conventional HA. The operating frequencies of the skeleton SHAs can be decreased by increasing the length of their arms.

FIG. 19(*a*)-19(*h*) compare the measured RHCP and LHCP elevation pattern for $\varphi=0°$ and $\varphi=90°$ for the skeleton SHAs at both the right-hand state and the left-hand state. The prototypes were measured in a StarLab anechoic chamber at the operating frequencies of the SHAs (i.e., the hexagon SHA was measured at 1.08 GHz, and the square SHA was measured at 1.16 GHz). It is evident that both antennas work in the axial mode, and the maximum gain is along their central axis. The level of cross-polarization gain is approximate 20 dB lower than the co-polarization gain over the main beam direction. The RHCP and LHCP gain can be switched when the skeleton SHAs are rotated from their right-handed state to their left-handed state. The slight difference between the pattern shapes at the two states can be attributed to the fact that the physical structure of the copper wire is not exactly the same at the two states.

The gain of helical antennas operating at the axial mode depends on the number of turns. Specifically, the gain increases as the number of turns increases. However, the gain does not increase linearly with the number of turns. In fact, for a large number of turns, an increase in the number of turns does not necessarily result in more directional radiation pattern. Practical helical antennas have 5 to 15 turns. FIG. 26 shows the variation of the simulated gain versus the number of turns of our bifilar skeleton SHAs. From these simulation results, it is observed that increasing the number of turns beyond 10 turns does not significantly increase the gain of the SHAs. Also, higher gain can be achieved by using a reflector or helical antenna arrays.

Figure 20A:
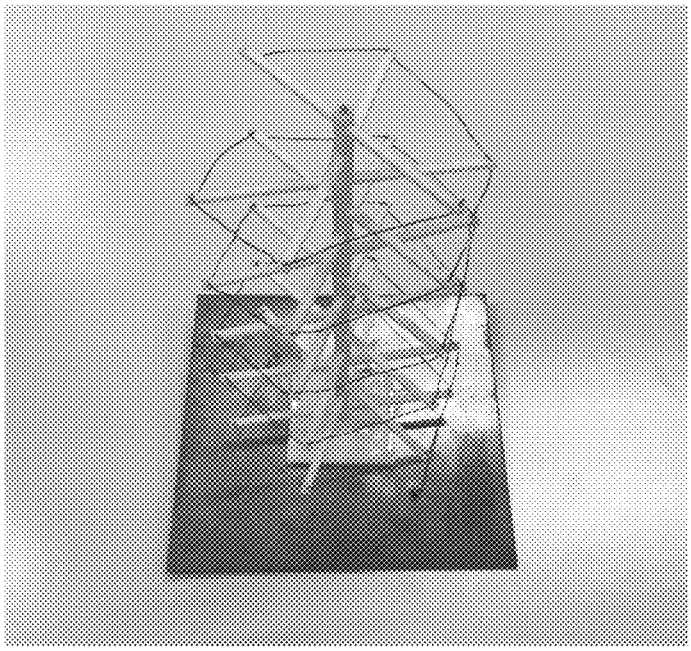
FIG. 20(*a*) shows a side view of the manufactured segmented helical antenna according to an embodiment of the subject invention.
Figure 20B:
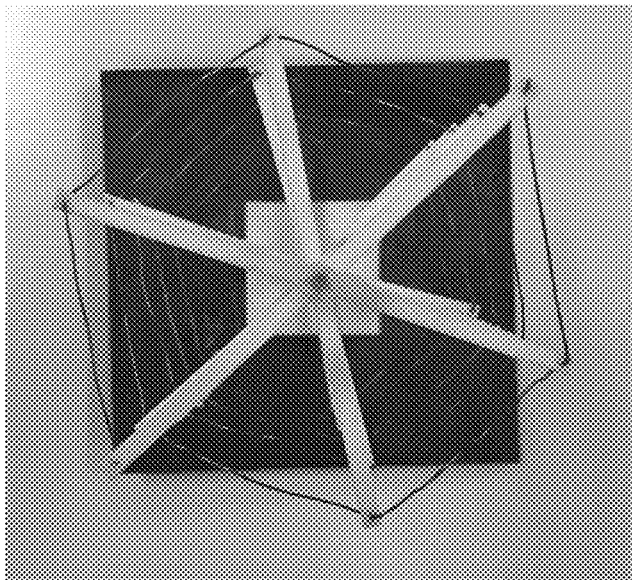

FIG. 20 shows the manufactured prototype of the segmented helical antenna according to an embodiment of the subject invention. FIG. 20(*a*) shows a side view of the manufactured segmented helical antenna and FIG. 20(*b*) shows a top view of the manufactured segmented helical antenna according to an embodiment of the subject invention. The central axis and arms were printed with PLA filament by a 3D printer. The dielectric constant of the PLA is 2.5. The copper wire used in the prototype is the magnet wire MW-24 with polyester coating.

Figure 21:
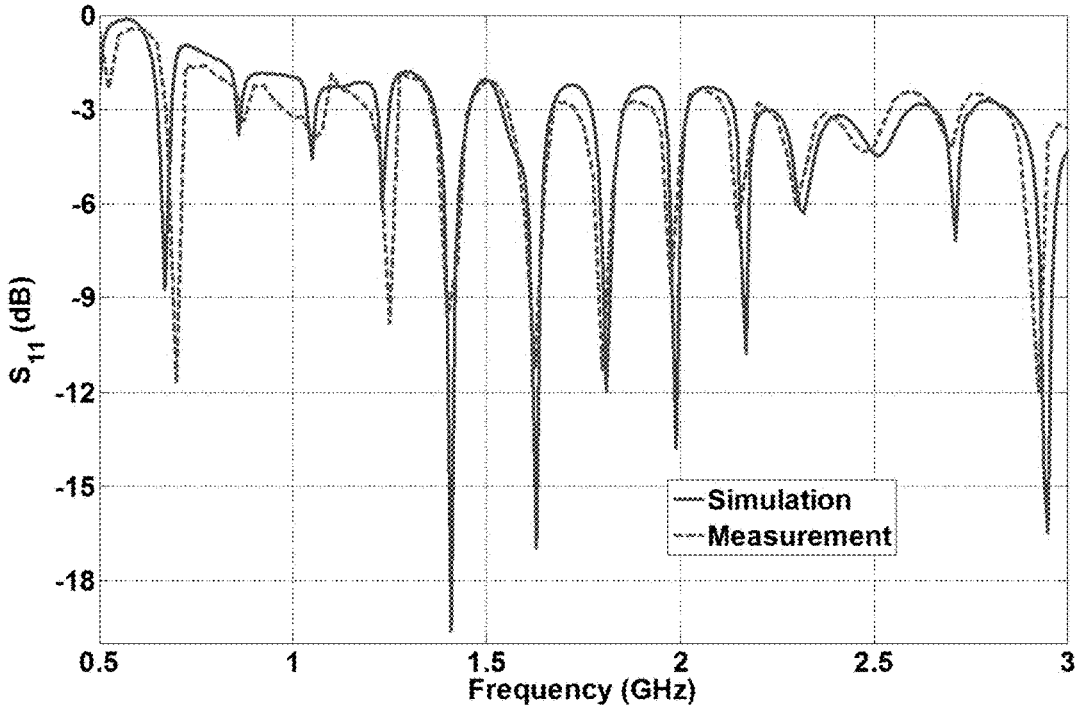
FIG. 21 shows measured and simulated return loss of the segmented helical antenna according to an embodiment of the subject invention.

FIG. 21 shows the simulated and measured return loss of the segmented helical antenna. Simulations were performed in ANSYS HFSS, and the measurements were obtained using Agilent E5071 Network Analyzer. There is a good agreement between the two plots. It is found that the helical antenna works at axial mode at 1.63 GHz.

Figure 22A:
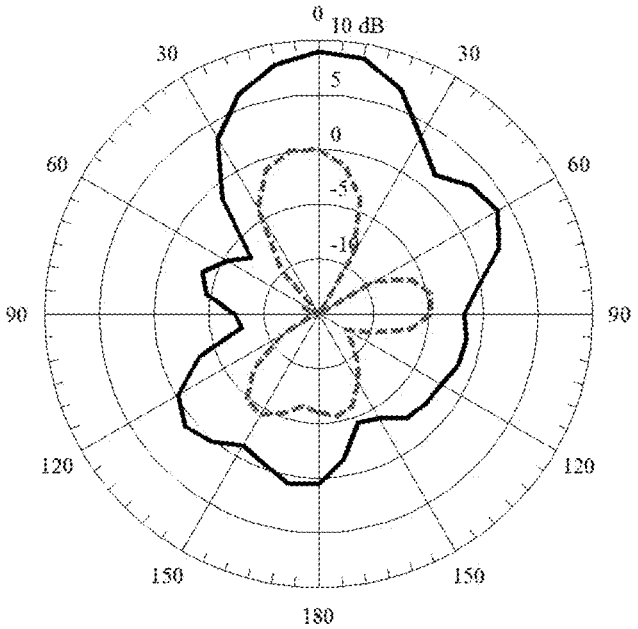
FIG. 22(*a*) shows the RHCP and LHCP realized gain pattern of the segmented helical antenna according to an embodiment of the subject invention at the right-handed state.
Figure 22B:
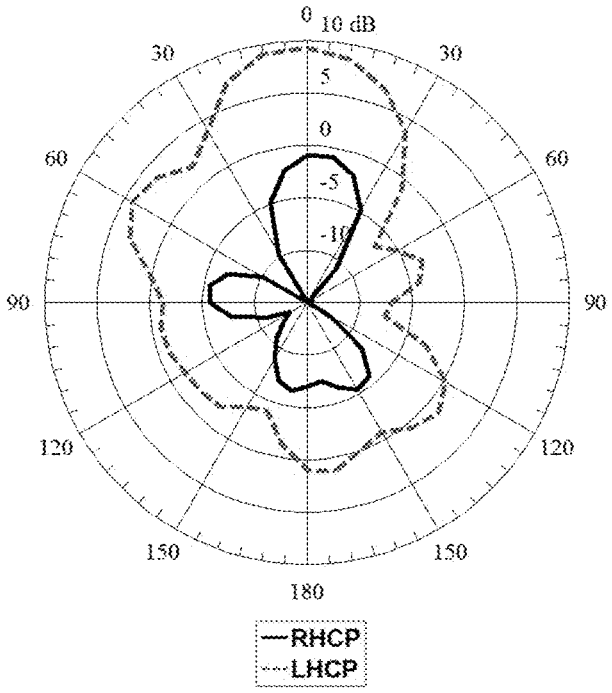

FIGS. 22(*a*) and 22(*b*) show the RHCP and LHCP realized gain pattern with phi=0° at 1.63 GHz of the segmented helical antenna according to an embodiment of the subject invention at the right-handed state and at the left-handed state, respectively. The prototype was measured in a StarLab anechoic chamber. It can be seen that the antenna is directional, and the peak gain is along the central axis. At the right-hand state, the measured RHCP realized gain is 8.6 dB, and the LHCP realized gain is 0.3 dB. Also, at the left-hand state, the LHCP field is clearly dominant. Therefore, as expected, the sense of polarization of this antenna can be switched by mechanical rotation. More discussion of the parameters of this design will be presented at the conference.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein (including those in the "References" section, if present) are incorporated by reference in their entirety, including all figures and tables, to the extent they are not inconsistent with the explicit teachings of this specification.

REFERENCES

[1] H. L. Knudsen, "Radiation field of a square, helical beam antenna," *Journal of applied physics*, vol. 23, no. 4, pp. 483-491, Apr. 1952.

[2] J. P. Casey and R. Bansal, "Square helical antenna with a dielectric core," *IEEE Trans. Eletromagn. Compat.*, vol. 30, no. 4, pp. 429-436, Nov. 1988.

[3] M. C. Britton, J. S. Wight and P. C. Strickland, "Low-cost square cross section helical antenna," in *Symp. on Antenna Technol. and Appl. Electromagn*, Winnipeg, Manitoba, Canada, Jul. 30-Aug. 2, 2000, pp. 425-428.

[4] Y. Wang and S. Chung, "A miniature quadrifilar helix antenna for global positioning satellite reception," *IEEE Trans. Antennas Propag.*, vol. 57, no. 12, pp. 3746-3751, Dec. 2009.

[5] M. B. Young, K. A. Connor and R. D. Curry, "Recucing the size of helical antennas by means of dielectric loading," in *IEEE Pulsed Power Conf.*, Chicago, Ill., Jun. 19-23, 2011, pp. 1-5.

[6] R. M. Barts, W. L. Stutzman, "A reduced size helical antenna," in Proc. *IEEE Antennas Propagat. Soc. Int. Symp.*, Jul. 13-18, 1997, pp. 1588-1591.

[7] S. A. Nauroze and M. M. Tentzeris, "A Novel Printed Stub-loaded Square Helical Antenna," in *IEEE Antennas Propagat. Soc. Int. Symp.*, Vancouver, BC, Canada, Jul. 19-24, 2015, pp. 774-775.

[8] A. Takacs, N. J. G. Fonseca, H. Aubert, and X. Dollat, "Miniaturization of quadrifilar helix antenna for VHF band applications," in *Proc. Loughborough Antennas Propagat. Conf.,* 2009, pp. 597-600.

[9] D. K. C. Chew and S. R. Saunders, "Meander Line Technique for Size Reduction of Quadrifilar Helix Antenna," *IEEE Antennas Wireless Propag. Lett.*, vol. 1, pp. 109-111, 2002.

[10] S. Hebib, N. J. G. Fonseca and H. Aubert, "Compact printed quadrifilar helical antenna with iso-flux-shaped pattern and high cross-polarization discrimination," *IEEE Antennas Wireless Propag. Lett.*, vol. 10, pp. 635-638, 2011.

[11] J. Rabemanantsoa and A. Sharaiha, "Size reduced multi-band printed quadrifilar helical antenna," *IEEE Trans. Antennas Propag.*, vol. 59, no. 9, pp. 3138-3143, Sep. 2011.

[12] J. Constantine, Y. Tawk, I. Maqueda, M. Sakovsky, G. Olson, S. Pellegrino and C. G. Christodoulou, "UHF deployable helical antennas for CubeSats," *IEEE Trans. Antennas Propag.*, vol. 64, no. 9, pp. 3752-3759, Sep. 2016.

[13] X. Liu, S. Yao, B. S. Cook, M. M. Tentzeris and S. V. Georgakopoulos, "A reconfigurable origami axial-mode helical antenna," *IEEE Trans. Antennas Propagat.*, vol. 63, no. 12, pp. 5897-5903, Dec. 2015.

[14] X. Liu, S. Yao and S. V. Georgakopoulos, "Frequency reconfigurable origami quadrifilar helical antenna with reconfigurable reflector," in *IEEE Antennas Propagat. Soc. Internat. Symp.*, Vancouver, BC, Jul. 19-24, 2015, pp. 2263-2264.

[15] C. Hsu, S. Lin and Y. Lin, "Dual-frequency dual-sense circular polarization on asymmetric crossed-dipole antenna," in *IEEE Antennas Propagat. Soc. Internat. Symp.,*
Chicago, Ill., Jul. 8-14, 2012.

[16] X. L. Bao and M. J. Ammann, "Monofilar spiral slot antenna for dual-frequency dual-sense circular polarization," *IEEE Trans. Antennas Propagat.*, vol. 59, no. 8, pp. 3061-3065, Aug. 2011.

[17] M. Boti, L. Dussopt and J. M. Laheurte, "Circularly polarised antenna with switchable polarisation sense," *Electronics Letters*, vol. 36, no. 18, pp. 1518-1519, 2000.

[18] Y. Ushijima, E. Nishiyama and M. Aikawa, "Circular polarization switchable microstrip antenna with SPDT switching circuit," in *IEEE Antennas Propagat. Soc. Internat. Symp.*, Toronto, ON, Jul. 11-17, 2010.

[19] E. Demaine and M. Demaine, "History of curved origami sculpture," [Online]. Available: http://erikdemaine.org/curved/history/

[20] E. Demaine, M. Demaine and A. Lubiw, "Polyhedral sculptures with hyperbolic paraboloids," in *Proc. of the 2nd Annu. Conf. of BRIDGES: Math. Connections in Art, Music, and Sci.*, Winfield, Kans., Jul. 30-Aug. 1, 1999, pp. 91-100.

[21] S. Yao, X. Liu and S. V. Georgakopoulos, "Polarization switchable origami helical antenna," in *IEEE Antennas Propagat. Soc. Internat. Symp.*, Fajardo, Puerto Rico, Jun. 26-Jul. 1, 2016, pp. 1667-1668.

[22] W. Eakasit, "Helical antennas with truncated spherical geometry," M. S. thesis, Dept. Elect. Comput. Eng., VirginiaTech Univ., Blacksburg, V A, 2000.

[23] X. Li, Q. Liu, J. Zhang and L. Zhao, "16-Element single-layer rectangular radial line helical array antenna for high-power applications," *IEEE Antennas Wireless Propag. Lett.*, vol. 9, pp. 708-711, 2010.

What is claimed is:

1. A segmented helical antenna, comprising:

a plurality of foldable units having a plurality of metal traces;

a support post passing through the plurality of foldable units; and an arm disposed on a top of the support post and glued on a top edge of the plurality of foldable units, the plurality of foldable units being configured to be rotatable with the arm such that the plurality of metal traces extends in a clockwise direction or in a counterclockwise direction, the support post being collapsible, and the plurality of foldable units being configured to be folded by the arm as the support post collapses.

2. The segmented helical antenna according to claim 1, each of the plurality of foldable units including a first metal trace and a second metal trace of the plurality of metal traces respectively on a first side and a second side thereof.

3. The segmented helical antenna according to claim 2, each of the plurality of foldable units having a rectangle unit, and the first side and the second side are a left side and a right side of the rectangle unit, respectively.

4. The segmented helical antenna according to claim 3, the plurality of foldable units being made of paper or a polyimide film.

5. The segmented helical antenna according to claim 1, the plurality of metal traces being made of copper.

6. A segmented helical antenna, comprising:

a plurality of unit arms, each of plurality of unit arms having a center hole, a first end hole, and a second end hole;

a central axis passing through the center hole of the plurality of unit arms;

a first wire passing through the first end hole of each of the plurality of unit arms; and a second wire passing through the second end hole of each of the plurality of unit arms, each of the plurality of unit arms being configured to be rotatable such that the first wire and the second wire rotate clockwise or counterclockwise.

7. The segmented helical antenna according to claim 6, further comprising a hollow cylinder disposed between the plurality of unit arms.

8. The segmented helical antenna according to claim 7, the central axis passing through the hollow cylinder.

9. The segmented helical antenna according to claim 8, the plurality of unit arms being arranged such that the first wire and the second wire form a square shape or a hexagon shape when viewed from a top of the segmented helical antenna.

10. The segmented helical antenna according to claim 8, one end of each of the first wire and the second wire being connected to a 50 ohm excitation and the other end of each of the first wire and the second wire being fixed on a top arm of the plurality of unit arms.

11. The segmented helical antenna according to claim 10, each of the plurality of unit arms being rotated to form a right-handed state or a left-handed state, and the right-handed state and the left-handed state being switched between each other by rotating the top arm of the plurality of unit arms.

12. The segmented helical antenna according to claim 6, further comprising a thread, each of the plurality of unit arms including a thread hole adjacent to the center hole, and the thread being fixed on each of the plurality of unit arms through its respective thread hole.

13. The segmented helical antenna according to claim 12, the thread being configured to pull the plurality of unit arms upward along the central axis.

14. The segmented helical antenna according to claim 13, the central axis being a telescoping metal post.

15. The segmented helical antenna according to claim 6, the first wire and the second wire being made of copper.

16. A segmented helical antenna, comprising:

a plurality of unit arms, each of plurality of unit arms having a center hole, a first end hole, and a second end hole;

a plurality of posts disposed between the plurality of unit arms;

a first wire passing through the first end hole of each of the plurality of unit arms; and a second wire passing through the second end hole of each of the plurality of unit arms, each of the plurality of posts including a first portion supporting the plurality of unit arms and a second portion passing through the center hole of the plurality of unit arms, each of the plurality of unit arms being rotatable, the first wire being connected to a connector and the second wire being connected to a ground, and the plurality of unit arms being configured to mechanically rotate such that a right-handed state and a left-handed state are switchable by rotating the plurality of unit arms.

17. The segmented helical antenna according to claim 16, the connector being a 50 ohm connector.

18. The segmented helical antenna according to claim 16, the ground being a copper sheet.

19. The segmented helical antenna according to claim 18, the first wire and the second wire being made of copper.

* * * * *